US010995510B2

(12) United States Patent
Lo Ricco

(10) Patent No.: US 10,995,510 B2
(45) Date of Patent: May 4, 2021

(54) CONNECTOR ASSEMBLY FOR WALL PANEL

(71) Applicant: UWM Research Foundation, Inc., Milwaukee, WI (US)

(72) Inventor: Marco Lo Ricco, Milwaukee, WI (US)

(73) Assignee: UWM Research Foundation, Inc., Milwaukee, WI (US)

( * ) Notice: Subject to any disclaimer, the term of this patent is extended or adjusted under 35 U.S.C. 154(b) by 116 days.

(21) Appl. No.: 16/359,504

(22) Filed: Mar. 20, 2019

(65) Prior Publication Data

US 2020/0095794 A1 Mar. 26, 2020

Related U.S. Application Data

(60) Provisional application No. 62/734,062, filed on Sep. 20, 2018.

(51) Int. Cl.

| | |
|---|---|
| ***E04H 9/02*** | (2006.01) |
| ***E04B 9/22*** | (2006.01) |
| ***E04B 5/43*** | (2006.01) |

(52) U.S. Cl.

CPC ..... *E04H 9/023* (2013.01); *E04B 5/43* (2013.01); *E04B 9/22* (2013.01); *E04H 9/0235* (2020.05)

(58) Field of Classification Search

CPC ..... E04H 9/02; E04H 9/021; E04H 9/023; E04H 9/0235; E04H 9/0237; E04H 9/0215; E04B 1/98; E04B 5/43; E04B 9/22

See application file for complete search history.

(56) References Cited

U.S. PATENT DOCUMENTS

| | | | | |
|---|---|---|---|---|
| 4,402,483 | A | 9/1983 | Kurabayashi et al. | |
| 5,005,326 | A * | 4/1991 | Ishimaru | F16F 15/02 52/167.2 |
| 5,727,663 | A | 3/1998 | Taylor | |
| 5,732,802 | A * | 3/1998 | Tsukagoshi | F16F 15/08 188/378 |

(Continued)

FOREIGN PATENT DOCUMENTS

JP 3343336 B2 11/2002

OTHER PUBLICATIONS

Aaleti, S., et al, "A simplified analysis method for characterizing unbonded posttensioned precast wall systems," Engineering Structures, 2009. 31(12): p. 2966-2975.

(Continued)

*Primary Examiner* — Christine T Cajilig
(74) *Attorney, Agent, or Firm* — Quarles & Brady LLP

(57) ABSTRACT

A panel assembly for a building includes a panel configured to extend between a first surface and a second surface. The panel is movable along a predetermined path relative to the first surface and the second surface. A first pin and a second pin are coupled to the panel. A first bottom face plate is positioned on a first side and defines a first slot. A second bottom face plate is positioned on a second side and defines a second slot. A first top face plate is positioned on the first side and defines a third slot. A second top face plate is positioned on the second side and defines a fourth slot. The first pin is movable in the first slot and the second slot, and the second pin is movable in the third slot and the fourth slot for guiding movement of the panel along the predetermined path.

20 Claims, 23 Drawing Sheets

(56) References Cited

U.S. PATENT DOCUMENTS

| | | | | |
|---|---|---|---|---|
| 6,085,472 | A * | 7/2000 | Malhotra | E04H 9/02 248/188.1 |
| 6,223,483 | B1 * | 5/2001 | Tsukagoshi | E04H 9/0237 52/167.1 |
| 8,935,892 | B2 | 1/2015 | Buchanan et al. | |
| 2004/0071372 | A1 | 4/2004 | Osmun et al. | |
| 2005/0257451 | A1 * | 11/2005 | Pryor | E04H 9/14 52/167.4 |
| 2006/0260222 | A1 * | 11/2006 | Lee | E04H 9/023 52/167.5 |
| 2012/0304587 | A1 * | 12/2012 | Kenho | F16F 15/073 52/699 |
| 2016/0108613 | A1 * | 4/2016 | Sato | E04B 1/98 52/167.1 |
| 2018/0328067 | A1 * | 11/2018 | Blomgren | E04C 5/02 |
| 2020/0248445 | A1 * | 8/2020 | Bucklitsch | E04B 1/98 |

OTHER PUBLICATIONS

American Society of Civil Engineers, Chapter 11: Seismic Design Criteria, in ASCE 7, Minimum Design Loads for Buildings and Other Structures. 2013, ASCE: Reston, VA.

American Society of Civil Engineers, Chapter 12: Seismic Design Requirements for Building Structures, in Minimum Design Loads for Buildings and Other Structures. 2013, ASCE: Reston, VA, USA. p. 59-85.

American Society of Civil Engineers, Chapter 17: Seismic Design Requirements for Seismically Isolated Structures, in Minimum Design Loads for Buildings and Other Structures. 2013, ASCE: Reston, VA, USA. p. 123-131.

American Society of Civil Engineers, Chapter 17: Seismic Design Requirements for Seismically Isolated Structures, in Minimum Design Loads for Buildings and Other Structures. 2016, ASCE/SEI 7: Reston, VA, USA. p. 168-179.

American Wood Council, "2012 Code Conforming Wood Design" 2013, Leesburg, VA: American Wood Council.

Amini, M.O., et al., "Overview of a project to quantify seismic performance factors for cross laminated timber structures in the United States", Materials and joints in timber structures. 2014, Springer. p. 531-541.

ANSI/APA PRG 320, Standard for Performance-Rated Cross-Laminated Timber. 2012, APA—The Engineered Wood Association: Tacoma, Washington. p. 1-23.

ANSYS, I, ANSYS Mechanical APDL Contact Technology Guide, in Online Documentation. 2016, SAS IP: Canonsburg, PA.

ANSYS, I, ANSYS Parallel Processing Guide, in Online Documentation. 2016, SAS IP: Canonsburg, PA.

APA—The Engineered Wood Association, Structurlam Crosslam Product Report PR-L314. 2015, APA: Tacoma, Washington. p. 1-4.

Applied Building Technology Council, Quantification of Building Seismic Performance Factors, FEMA P695. 2009, Federal Emergency Management Agency (FEMA): Washington D.C.

Athena Sustainable Materials Institute, A Life Cycle Assessment of Cross-Laminated Timber Produced in Canada. 2013: Ottawa, ON.

Athukorallage, B., et al, Roulettes of conics, Delaunay surfaces and applications. Surveys in Mathematics and Mathematical Sciences, 2014. 4(1): p. 1-20.

Binational Softwood Lumber Council, publicly available at least as early as Sep. 21, 2010, http://www.softwoodlumber.org/about-us/overview.html.

Blaß, H.J., et al, Ductility aspects of reinforced and non-reinforced timber joints. Engineering Structures, 2011. 33(11): p. 3018-3026.

Bora, C., et al., Development of a precast concrete shear-wall system requiring special code acceptance. PCI journal, 2007. 52(1): p. 122.

Buchanan, "Base Isolation and Damage-Resistant Technologies for Improved Seismic Performance of Buildings", Department of Civil and Natural Resources Engineering, University of Canterbury Research Report No. 2011-02, Christchurch, New Zealand, Aug. 2011.

Building Seismic Safety Council, NEHRP Recommended Seismic Provisions for New Buildings and Other Structures (FEMA P-750). 2009, Federal Emergency Management Agency (FEMA): Washington D.C.

Ceccotti, A., et al., SOFIE project—3D shaking table test on a seven-storey full-scale crosslaminated timber building. Earthquake Engineering & Structural Dynamics, 2013. 42(13): p. 2003-2021.

Ceccotti, A., "New technologies for construction of medium-rise buildings in seismic regions: the XLAM case," Structural Engineering International, 2008. 18(2): p. 156-165.

Ceccotti, A.F., et al, "Seismic Behavior of Multi-Storey XLam Buildings, in International Workshop on Earthquake Engineering on Timber Structures," 2006, COST E29—European Cooperation in the Field of Scientific and Technical Research: Coimbra, Portugal. p. 81-95.

Chen, Y., et al., "Bending Performance of Box-Based Cross-Laminated Timber Systems," Journal of Structural Engineering, 2013. 139(12): p. 04013006.

Chopra, A.K., 21.4 Base-Isolated Multistory Buildings, in Dynamics of Structures: Theory and Applications to Earthquake Engineering, H. Stark, Editor. 2012, Prentice Hall: Upper Saddle River, NJ. p. 822-828.

Crespell, P., et al, "The Value Proposition for Cross-laminated Timber" 2011: FPInnovations.

Dantech Dynamics, DIC—Digital Image Correlation, publicly available at least as early as Oct. 19, 2013, https://www.dantecdynamics.com/digital-image-correlation.

Dodoo, A., L., et al., "Carbon implications of end-of-life management of building materials," Resources, Conservation and Recycling, 2009. 53(5): p. 276-286.

Dodoo, A., L., et al. "Lifecycle carbon implications of conventional and low energy multi-storey timber building systems," Energy and Buildings, 2014. 82: p. 194-210.

Dolan, J.D., et al., "Tall Cross-Laminated Timber Building: Design and Performance Session WW300 Experimental and Modeling Studies on Wood Frame Buildings," in Structures Congress 2014. 2014. p. 2886-2893.

Doshin Rubber Engineering, "Friction Pendulum", <https://doshinrubber.com/friction-pendulum/>, webpage publicly available at least as early as Jul. 18, 2017.

Dujic, B. et al, "Study of lateral resistance of massive X-lam wooden wall system subjected to horizontal loads, in International Workshop on Earthquake Engineering on Timber Structures," 2006, COST E29—European Cooperation in the Field of Scientific and Technical Research: Coimbra, Portugal. p. 97-104.

Dujič, B., et al. Prediction of dynamic response of a 7-storey massive XLam wooden building tested on a shaking table. in Proceedings of the World Conference on Timber Engineering WCTE, Riva del Garda, Italy. 2010.

Dujic, B., et al., "Testing of racking behavior of massive wooden wall panels," In Proceedings of the 37th CIB-W18 Meeting, Edinburgh, Scotland. 2004.

Dujic, B., S., et al., "Investigations on in-plane loaded wooden elements—influence of loading and boundary conditions," Otto-Graf-Journal, 2005. 16: p. 259-272.

Dujic, B., et al, "Influence of Openings on Shear Capacity of Massive Cross-Laminated Wooden Walls," in International Workshop on Earthquake Engineering on Timber Structures. 2006, COST E29—European Cooperation in the Field of Scientific and Technical Research: Coimbra, Portugal. p. 105-118.

Dunbar, A., S., et al., "Seismic performance of core-walls for multi-story timber buildings," 2014.

Earthquake Protection Systems, "Friction Pendulum Isolators", <https://www.earthquakeprotection.com/products>, webpage publicly available at least as early as Jun. 29, 2019.

Federal Emergency Management Agency (FEMA), HAZUS® MH Estimated Annualized Earthquake Losses for the United States / FEMA 366. 2008, Federal Emergency Management Agency (FEMA): Washington D.C.

Forest Products, L., 3.9 Coefficient of Friction, in Wood Handbook—Wood as an Engineering Material. U.S. Department of Agriculture.

FPInnovations, Environmental Product Declaration: Crosslam by Structurlam. 2013: Vancouver,BC.

(56) References Cited

OTHER PUBLICATIONS

FPInnovations, Environmental Product Declaration: Nordic X-Lam. 2013: Vancouver, BC.
Fragiacomo, M., B. et al., "Elastic and ductile design of multi-story crosslam massive wooden buildings under seismic actions," Engineering Structures, 2011. 33(11): p. 3043-3053.
French, M., Vienna plans world's tallest wooden skyscraper, The Guardian, 2015.
Gagnon, S., et al., Introduction to cross-laminated timber, in CLT handbook: cross-laminated timber, U.S. edition, E. Karacabeyli and B. Douglas, Editors. 2013, U.S. Department of Agriculture, Forest Service, Forest Products Laboratory, and Binational Softwood Lumber Council (BSLC): Pointe-Claire, Quebec, Canada. p. 45.
Gavric, I., et al., Behaviour of Cross-Laminated Timber Panels under Cyclic Loads, in Materials and Joints in Timber Structures, S. Aicher, H.W. Reinhardt, and H. Garrecht, Editors. 2014, Springer Netherlands. p. 689-702.
Gavric, I., M, et al, Cyclic Behavior of CLT Wall Systems: Experimental Tests and Analytical Prediction Models. Journal of Structural Engineering, 2015. 0(0): p. 04015034.
Gavric, I., M., et al, "Cyclic behavior of typical screwed connections for cross-laminated (CLT) structures," European Journal of Wood and Wood Products, 2015. 73(2): p. 179-191.
GmbH, K.M., Company Facts, website publicly available at least as early as Aug. 8, 2013, <http://www.klh.at/en/company/facts.html>.
Grainger, Vibration Isolation Pads, <https://www.grainger.com/product/MASON-Vibration-Isolation-Pad-4C977>, webpage publicly available at least as early as Feb. 2019.
Grann, B., Wood Innovation and Design Centre Whole Building Life Cycle Assessment. 2014: Vancouver, British Columbia, Canada.
Green, M. et al, Tall Wood: The Case for Tall Wood Buildings. Vancouver: Wood Enterprise Coalition, 2012.
Green, M., Why we should build wooden skyscrapers, in TED Talk. <https://www.ted.com/talks/michael_green_why_we_should_build_wooden_skyscrapers?language=en> 2013.
Grigorian, C.E., et al, "Slotted bolted connection energy dissipators," Earthquake Spectra, 1993. 9(3): p. 491-504.
Gu, M., et al, "Displacement Design Procedure for Cross Laminated Timber (CLT) Rocking Walls with Sacrificial Dampers," Structures Congress 2015, p. 2777-2791.
Gustavsson, L., et al, "Energy and CO2 analysis of wood substitution in construction," Climatic Change, 2011. 105(1-2): p. 129-153.
Gustavsson, L., A. et al., "Life cycle primary energy use and carbon emission of an eight-story wood-framed apartment building," Energy and Buildings, 2010, 42(2): p. 230-242.
Harvey Jr., et al, "A review of rolling-type seismic isolation: Historical development and future directions." School of Civil Engineering and Environmental Science, University of Oklahoma, Norman OK, available online Jul. 29, 2016.
Hashemi, "Seismic resilient lateral load resisting system for timber structures", Construction and Building Materials, vol. 149, Sep. 15, 2017, pp. 432-443.
Hochreiner, G., J., et al., "Cross-laminated Timber Plates Subjected to Concentrated Loading," Strain, 2014. 50(1): p. 68-81.
Holden, T., J. et al, "Seismic Performance of Precast Reinforced and Prestressed Concrete Walls. Journal of Structural Engineering," 2003. 129(3): p. 286-296.
Housner, G.W., "The behavior of inverted pendulum structures during earthquakes," Bulletin of the seismological society of America, 1963. 53(2): p. 403-417.
Hristovski, V., et al, "Full-Scale Shaking-Table Tests of XLam Panel Systems and Numerical Verification: Specimen 1," Journal of Structural Engineering, 2013. 139(11): p. 2010-2018.
IBU—Institut Bauen and Umwelt e.V., Environmental Product Declaration, According to ISO 14025, for KLH Solid timber Panels (Cross-Laminated Timber). 2012: Königswinter, Germany.
Insurance Institute for High Safety (IIHS). 2018 Maserati Ghibli Safety Ratings 2018 [cited 2018 Mar. 16, 2018]; website available at least as early as: Mar. 26, 2015, <http://iihs.org/iihs/ratings/vehicle/v/maserati/ghibli-4-door-sedan>.
Jickling, J., FSC Chain of Custody Certification for Nordic Wood Structures, Forest Stewardship Council, Editor. 2013, Rainforest Alliance: New York, New York.
Johnson, N., Forte by Lend Lease commended at 2014 Sustainability Awards, in Architecture & Design. 2014: Australia.
Joyce, T., I. et al, "Mechanical behaviour of in-plane shear connections between CLT wall panels," Proceedings of the CIB Working Commission W18—Timber Structures. 44th meeting, Alghero. 2011.
Karacabeyli, E. et al., Design for earthquake Resistance, in Timber Engineering. 2003. p. 267-299.
Kircher, C.A., Seismically Isolated Structures, in 2009 NEHRP Recommended Seismic Provisions: Design examples. FEMA P-751, M.T. Valley, Editor. 2012, Federal Emergency Management Agency (FEMA): Washington D.C. p. 12-1-63.
Kovacs, "Controlled Rocking Cross-Laminated Timber Walls for Regions of Low-to-Moderate Seismicity", World Conference on Timber Engineering, Vienna, Austria, Aug. 2016.
Kurama, Y.C., Hybrid post-tensioned precast concrete walls for use in seismic regions. PCI journal/, 2002. 47(5): p. 36.
Kurama, Y.C., Seismic design of partially post-tensioned precast concrete walls. PCI journal /,2005. 50(4): p. 100.
Laguarda Mallo, M.F. et al, "Awareness, perceptions and willingness to adopt Cross-Laminated Timber by the architecture community in the United States," Journal of Cleaner Production, 2015. 94(0): p. 198-210.
Lauriola, M.P. et al., "Quasi-Static and Pseudo-Dynamic Tests on XLAM Walls and Buildings," International Workshop on Earthquake Engineering on Timber Structures. 2006, COST E29: Coimbra, Portugal. p. 119-133.
Lend Lease, Forté: World's Tallest Timber Apartments, Melbourne Docklands, website publicly available at least as early as May 31, 2012 <http://www.forteliving.com.au/>.
Levan-Green, S.L., et al, "Uses for small-diameter and low-value forest thinnings," Ecological restoration, 2003. 21(1): p. 34-38.
Lippke, B., et al., CORRIM: Life-cycle environmental performance of renewable building materials. Forest Products Journal, 2004. 54(6): p. 8-19.
Londhe Y. et al, "Dynamic Response of structures supported on elliptical rolling rods," Doboku Gakkai Ronbunshu, 1999. 612: p. 11-20.
Londhe Y. et al, "Effectiveness of Elliptical Rolling Rods for Base Isolation," Journal of Structural Engineering, Apr. 1998, 124(4): 469-472.
Loo, W.Y., et al., Experimental testing of a rocking timber shear wall with slip-friction connectors. Earthquake Engineering & Structural Dynamics, 2014. 43(11): p. 1621-1639.
Loo, W.Y., et al., "Design and numerical verification of a multistorey timber shear wall with slip-friction connectors," Auckland, New Zealand: Proc of World Conference on Timber Engineering. 2012.
Lu, L.-Y., et al, "Theory and experimental study for sliding isolators with variable curvature," Earthquake Engineering & Structural Dynamics, 2011. 40(14): p. 1609-1627.
M. Levine, et al, "Residential and commercial buildings," Climate Change 2007: Mitigation. Contribution of Working Group III to the Fourth Assessment Report of the Intergovernmental Panel on Climate Change, O.R.D. B. Metz, P.R. Bosch, R. Dave, L.A. Meyer, Editor. 2007, Cambridge University Press: Cambridge, United Kingdom and New York, NY, USA.
Mahlum, Walsh Construction Company, Coughlin Porter Lundeen, CLT Feasibility Study: a Study of Alternative Construction Methods in the Pacific Northwest. 2014: Seattle, Washington.
Marriott, D., et al., Dynamic testing of precast, post-tensioned rocking wall systems with alternative dissipating solutions. 2008.
Mazzoleni, M.J., et al, "Dynamics of Rocking Semicircular, Parabolic, and Semi-Elliptical Disks: Equilibria, Stability, and Natural Frequencies," Journal of Vibration and Acoustics, 2015. 137(4): p. 041017-041017.
Michael Golser, M.B., FSC Chain of Custody Certification for KLH Massivholz Gmbh, Forest Stewardship Council, Editor. 2015, Holz Forschung Austria: Vienna, Austria.

(56) References Cited

OTHER PUBLICATIONS

Michael Green Architecture, Roosevelt Campus, website available at least as early as Oct. 9, 2014, <http://mg-architecture.ca/work/tall-wood>.
Moody, R.C., et al., "Glued-laminated timber," Engineered Wood Products, A Guide for Specifiers, Designers and Users. PFS Research Foundation. Madison, 1997.
Morgan, T.A., et al, "The use of base isolation systems to achieve complex seismic performance objectives," Pacific Earthquake Engineering Research Center, 2011.
Moroder, D., et al., "Design of Floor Diaphragms in Multi-Story Timber Buildings," International Network on Timber Engineering Research. Bath, England, 2014.
Muszynski, L., et al. "Integrated method for multi-scale/multi-modal investigation of micromechanical wood-adhesive interaction," International Conference on Wood Adhesives. 2013.
Naturally Wood, Wood Innovation & Design Centre: Showcasing British Columbia's Expertise in Tall Wood Building Design and Construction, website publicly available at least as early as Jun. 9, 2015 <http://www.naturallywood.com/sites/default/files/wood-innovation-design-centre_0.pdf>.
Newmark, N.M., et al, "Earthquake spectra and design," Earth System Dynamics, 1982. 1.
Office of Technology Assessment, Wood Use in The United States, in Wood Use: U.S. Competitiveness and Technology, L.M.P. Kathryn White, Editor. 1983, U.S. Congress, Office of Technology Assessment: Washington D.C. p. 73-102.
Pearson, H., M., et al., "Analysis of engineered timber panels using a strut and tie model for use in folded plate structures and deep beams," Proceedings of the World Conference on Timber Engineering (WCTE) Session. 2012.
Pei, "Cross Laminated Timber for Seismic Regions: Progress and Challenges for Research and Implementation", Journal of Structural Engineering, vol. 142 Issue 4, Apr. 2016.
Pei, S., et al, Progress on the development of seismic resilient Tall CLT Buildings in the Pacific Northwest. in Proceedings of the 2014 World Conference on Timber Engineering, Quebec City, Canada. 2014.
Pei, S., et al, "Cross-Laminated Timber for Seismic Regions: Progress and Challenges for Research and Implementation," Journal of Structural Engineering, 2014. 0(0): p. E2514001.
Pei, S., et al, "Approximate R-Factor for Cross-Laminated Timber Walls in Multistory Buildings," Journal of Architectural Engineering, 2013. 19(4): p. 245-255.
Pei, S., et al, "Analytical study on seismic force modification factors for cross-laminated timber buildings," Canadian Journal of Civil Engineering, 2013. 40(9): p. 887-896.
Perez, F., et al, "Seismic design of unbonded post-tensioned precast concrete walls with vertical joint connectors," Pci Journal, 2004. 49(1): p. 58-+.
Perez, F.d.J., "Lateral Load Behavior and Design of Unbonded Post-Tensioned Precast Concrete Walls with Ductile Vertical Joint Connectors," 1998.
Perez, F.J., S. et al, "Lateral Load Behavior of Unbonded Post-Tensioned Precast Concrete Walls with Vertical Joints," PCI Journal, 2004. 49(2): p. 48-64.
Perkins + Will, Survey of International Tall Wood Buildings. 2014: Vancouver, Canada.
Popovski, M., et al, "Seismic behaviour of cross-laminated timber structures," Proceedings of the World Conference on Timber Engineering, Auckland, New Zealand. 2012.
Popovski, M., I. et al, "Performance of two-storey CLT house subjected to lateral loads," Proc. of the 13th World Conference on Timber Engineering. 2014.
Popovski, M., J., et al, "Lateral load resistance of cross-laminated wood panels," World Conference on Timber Engineering. 2010.
Pozza, L., et al., "Experimental and numerical analyses of new massive wooden shear-wall systems," Buildings, 2014. 4(3): p. 355-374.
Rammer, D., "Rocking Panel Delaminations," M.L. Ricco, Editor. 2015. p. 4.
Restrepo, J., et al, "Seismic Performance of Self-Centering Structural Walls Incorporating Energy Dissipators," Journal of Structural Engineering, 2007. 133(11): p. 1560-1570.
Rinaldin, G., C. et al, "A component approach for the hysteretic behaviour of connections in cross-laminated wooden structures," Earthquake Engineering & Structural Dynamics, 2013. 42(13): p. 2023-2042.
Risbrudt, C.D., Wood and Society, in Handbook of Wood Chemistry and Wood Composites, Second Edition. 2012, CRC Press. p. 1-6.
Ritter, M.A., et al, "Science Supporting the Economic and Environmental Benefits of Using Wood and Wood Products in Green Building Construction," 2011: Madison, Wisconsin. p. 9.
Robertson, A.B., et al, "A Comparative Cradle-to-Gate Life Cycle Assessment of Mid-Rise Office Building Construction Alternatives: Laminated Timber or Reinforced Concrete Buildings," 2012. 2(3): p. 245-270.
Rowell, R.M., "Sustainability of Wood and Other Biomass," Handbook of Wood Chemistry and Wood Composites, Second Edition. 2012, CRC Press. p. 659-668.
Saavedra Flores, E.I., et al., Analysis of cross-laminated timber by computational homogenisation and experimental validation. Composite Structures, 2015. 121(0): p. 386-394.
Samuel V. Glass, et al, "Building enclosure design for cross-laminated timber construction," CLT Handbook: Cross-Laminated Timber, E.K.a.B. Douglas, Editor. 2013, U.S. Department of Agriculture, Forest Service, Forest Products Laboratory, and Binational Softwood Lumber Council (BSLC): Pointe-Claire, Quebec, Canada. p. 41.
Sarti, F., A., et al., "Quasi-Static Cyclic Testing of Two-Thirds Scale Unbonded Posttensioned Rocking Dissipative Timber Walls," Journal of Structural Engineering, 2015. 0(0): p. E4015005.
Sathre, R. et al, "Meta-analysis of greenhouse gas displacement factors of wood product substitution," Environmental Science & Policy, 2010. 13(2): p. 104-114.
Sathre, R.et al, "Using wood products to mitigate climate change: External costs and structural change," Applied Energy, 2009. 86(2): p. 251-257.
Satterly, J., "Some Experiments in Dynamics, Chiefly on Vibrations," American Journal of Physics, 1950. 18(7): p. 405-416.
Satterly, J., "The Moment of Inertia and the Period of the Rocking of an Elliptic Band," American Journal of Physics, 1951. 19(9): p. 511-513.
Satterly, J., "Three Interesting Instances of Rocking," American journal of physics., 1955. 23(1): p. 14.
Schneider, J., et al., "Assessment and comparison of experimental and numerical model studies of cross-laminated timber mechanical connections under cyclic loading," Construction and Building Materials, 2015. 77(0): p. 197-212.
Schneider, J., et al., "Damage Assessment of Connections Used in Cross-Laminated Timber Subject to Cyclic Loads," Journal of Performance of Constructed Facilities, 2014. 28(6): p. A4014008.
Schober, K.-U., et al., "FRP reinforcement of timber structures," Construction and Building Materials, 2015. 97: p. 106-118.
Schultz, A. et al, "Seismic behavior of connections in precast concrete walls," ACI Special Publication, 1996. 162. pp. 273-312.
Schultz et al. "Experimental study of joint connections in precast concrete walls." Proceedings—Fifth U.S. National Conference on Earthquake Engineering, vol. II, Jul. 1994.
Sebera, V., et al., "FE analysis of CLT panel subjected to torsion and verified by DIC," Materials and Structures, 2013. 48(1-2): p. 451-459.
Seim, W., et al, "Earthquake design of timber structures—Remarks on force-based design procedures for different wall systems," Engineering Structures, 2014. 76(0): p. 124-137.
Sezawa, K., et al, "On the Seismic Vibrations of a Gozyûnotô (Pagoda)," Earthquake Research Institute, 1936. XIV: p. 525-533.
Shadbolt, P., From skyscraper to 'plyscraper': The tower blocks made from wood, in CNN. 2015.
Shen, Y.-L., et al., "Hysteresis behavior of bracket connection in cross-laminated-timber shear walls. Construction and Building Materials," 2013. 48: p. 980-991.

(56) References Cited

OTHER PUBLICATIONS

Skidmore, Owings & Merrill, LLP, Timber Tower Research Project. 2014: Chicago, Illinois.
Smith, B.J., et al, "Design and Measured Behavior of a Hybrid Precast Concrete Wall Specimen for Seismic Regions," Journal of Structural Engineering, 2011. 137(10): p. 1052-1062.
Softwood Lumber Board. Funded Programs, website available at least as early as Jan. 28, 2015 <http://www.softwoodlumberboard.org/Programs/FundedPrograms.aspx>.
Sinha, "Strain Distribution in OSB and GWB in Wood-Frame Shear Walls," Journal of Structural Engineering, 2009. 135(6): p. 666-675.
Structurlam, Cross Laminated Timber Design Guide, Editor. 2015, Structurlam: Penticton, British Columbia, Canada.
Stürzenbecher, R., et al., "Bending of cross-ply laminated composites: An accurate and efficient plate theory based upon models of Lekhnitskii and Ren. Composite Structures," 2011. 93(3): p. 1078-1088.
Stürzenbecher, R., K. et al, "Structural design of Cross Laminated Timber (CLT) by advanced plate theories," Composites Science and Technology, 2010. 70(9): p. 1368-1379.
Susteric et al., Influence of the Connection Modelling on the Seismic Behaviour of Crosslam Timber Buildings, in Materials and Joints in Timber Structures, S. Aicher, H.W. Reinhardt, and H. Garrecht, Editors. 2014, Springer Netherlands. p. 677-687.
Tanabashi, R., "Earthquake Resistance of Traditional Japanese Wooden Structures," Bulletin [of the] Disaster Prevention Research Institute, 1960. 40: p. 1-15.
Twigden, "Dynamic testing of post-tensioned rocking walls", 15th World Conference on Earthquake Engineering, Jan. 2012.
UNEP SBCI, Buildings and Climate Change: A Summary for Decision-Makers. United Nations Environmental Programme, Sustainable Buildings and Climate Initiative, Paris, 2009: p. 1-62.
United Nations, Department of Economic and Social Affairs, Population Division, World Urbanization Prospects: The 2014 Revision, Highlights (ST/ESA/SER.A/352). 2014: New York, New York.
United States Geological Survey (USGS). U.S. Seismic Design Maps Tool. 2015 [cited Oct. 4, 2015]; website available at least as early as Mar. 24, 2014 <http://earthquake.usgs.gov/designmaps/us/application.php>.
Vick, C.B. et al, "Strength and durability of one-part polyurethane adhesive bonds to wood," Forest products journal, 1998. 48(11/12): p. 71.
Voyagaki, E., et al, "Complex Response of a Rocking Block to a Full-Cycle Pulse," Journal of Engineering Mechanics, 2014. 140(6): p. 04014024.
Waugh, A., M. et al, "Tall Timber Buildings: Application of Solid Timber Constructions in Multi-Storey Buildings", in International Convention of Society of Wood Science and Technology and United Nations Economic Commission for Europe. 2010: Geneva,Switzerland.
Yeh, B., D. et al, "Cross-laminated timber manufacturing," in CLT handbook: cross-laminated timber, U.S. edition, E. Karacabeyli and B. Douglas, Editors. 2013, U.S. Department of Agriculture, Forest Service, Forest Products Laboratory, and Binational Softwood Lumber Council (BSLC): Pointe-Claire, Quebec, Canada. p. 23.
Zhou, 15 WCEE Lisboa, "Earthquake-resilient Tall Buildings Using Rocking Walls" 2012.
McVitty and Taylor, "Chapter 15: Seismically Isolated Structure," 2015 NEHRP Recommended Seismic Provisions: Design Examples, FEMA P-1051, Jul. 2016: Washington, D.C.
Federal Emergency Management Agency (FEMA), "2015 NEHRP Recommended Seismic Provisions: Design Examples" FEMA P-1051, Jul. 2016: Washington, D.C.

* cited by examiner

CONNECTOR ASSEMBLY FOR WALL PANEL

CROSS-REFERENCE TO RELATED APPLICATIONS

This application claims priority to U.S. Provisional Patent Application No. 62/734,062, filed Sep. 20, 2018, the contents of which are incorporated herein by reference.

STATEMENT REGARDING FEDERALLY SPONSORED RESEARCH OR DEVELOPMENT

This invention was made with government support under 16-DG-11420004-170 awarded by the U.S. Department of Agriculture. The Government has certain rights in the invention.

FIELD OF THE INVENTION

Embodiments described herein relate to alleviating stresses on a building caused by seismically induced forces such as from earthquakes, and more particularly, to selective movement of wall panels of a building for decoupling superstructures (e.g., rigid structure of the building) from vibratory motions caused by the seismically induced forces.

SUMMARY

During seismic events, such as an earthquake, some buildings are not able to withstand the extreme forces generated and are damaged beyond repair by the seismic event.

At least some embodiments described herein allow selective movement of panels of a wall of a building for decoupling the rigid structure of the building from seismically induced forces applied to the building during a seismic event, thereby reducing one or more of the aforementioned issues.

In one aspect, a panel assembly for a building includes a panel configured to extend between a first surface and a second surface of the building. The panel is movable along a predetermined path relative to the first surface and the second surface. A first pin and a second pin is coupled to the panel. A first bottom face plate is positioned on a first side of the panel and a second bottom face plate is positioned on a second side of the panel opposite the first side. The first bottom face plate and the second bottom face plate are configured to be rigidly coupled to the first surface. The first bottom face plate defines a first slot and the second bottom face plate defines a second slot. A first top face plate is positioned on the first side of the panel and a second top face plate is positioned on the second side of the panel. The first top face plate and the second top face plate are configured to be rigidly coupled to the second surface. The first top face plate defines a third slot, and the second top face plate defines a fourth slot. The first pin is received in the first slot and the second slot, and the second pin is received in the third slot and the fourth slot. The first pin is movable in the first slot and the second slot, and the second pin is movable in the third slot and the fourth slot for guiding the movement of the panel along the predetermined path.

In another aspect, a wall connector assembly for selective movement of a panel forming a section of a wall of a building. The panel is configured to extend between a first surface and a second surface of the building. The wall connector assembly includes a first face plate configured to be positioned on one side of the panel. The first face plate defines a first slot. A second face plate is configured to be positioned on another opposite side of the panel. The second face plate defines a second slot. The wall connector assembly further includes a pin configured to be coupled to the panel, and received in the first slot and the second slot for relative movement therewith. The first face plate and the second face plate are configured to be rigidly coupled to one of the first surface and the second surface. The pin is movable in the first slot and the second slot for guiding movement of the panel along a predetermined path relative to the one of the first surface and the second surface.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Terms of degree, such as "substantially" or "approximately" are understood by those of ordinary skill to refer to reasonable ranges outside of the given value, for example, general tolerances associated with manufacturing, assembly, and use of the described embodiments. For example, "substantially" can be defined as being within about 5 percent to about 10 percent of a given value.

Illustrated herein are various embodiments of a panel assembly that forms a portion of a wall of a building. The panel assembly includes one or more wall connector assemblies for movably coupling a panel of the panel assembly to the rigid structure of the building. The panels are movable relative to the rigid structure such that each panel may be termed as a "rocking panel." The rocking panels are configured to move or rock to decouple and/or isolate the building or portions thereof from the seismically induced forces, such as during an earthquake, applied to the building. These seismically induced forces may also be re-directed by the movement of the rocking panels to passively re-center the walls of the building using the building's weight. The different types of buildings the panel assembly may be used for include houses, stores, laboratories, factories, warehouses, skyscrapers, and the like.

Figure 1A:
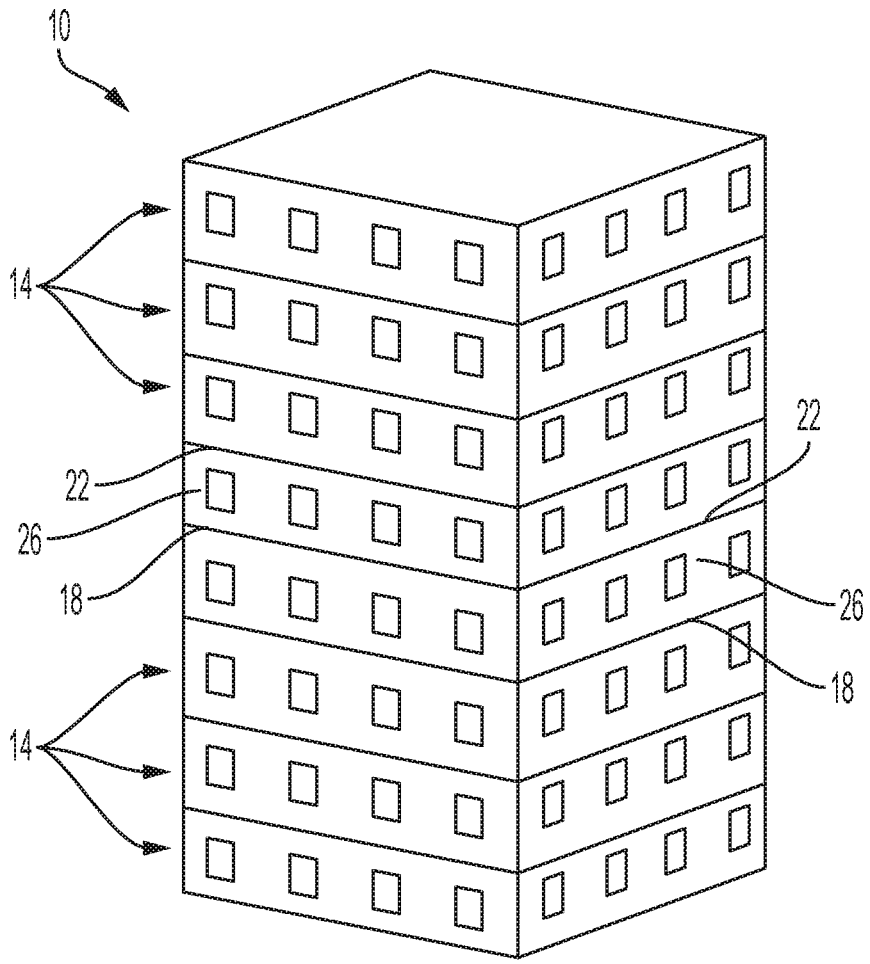
FIG. 1A is a perspective view of a building having walls and separated into multiple floor levels.
Figure 1B:
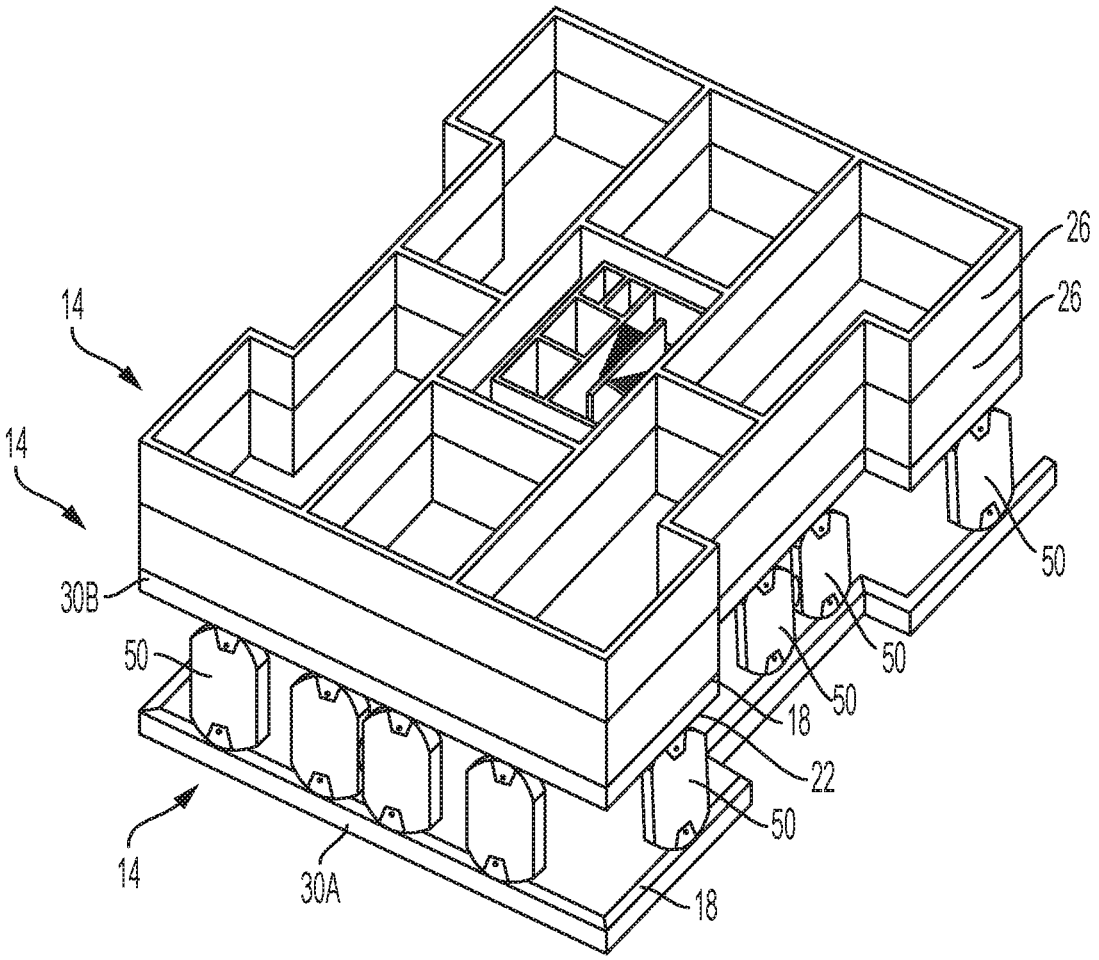
FIG. 1B is a perspective view of three floor levels such as the some of the floor levels of FIG. 1A.

FIG. 1A illustrates a building 10 having a plurality of floor levels 14. In the illustrated embodiment, the building includes eight floor levels 14. In other embodiments, the building 10 may include one or more floor levels 14. Each floor level 14 includes a floor structure 18, a ceiling structure 22, and a plurality of walls 26 extending between the floor structure 18 and the ceiling structure 22. FIG. 1B illustrates three floor levels 14 in which the lowermost floor level 14 is shown with some of the walls 26 removed and support beams 30A, 30B forming the respective floor and ceiling structures 18, 22 of the lowermost floor level 14. In particular, each floor level 14 is formed by the walls 26 that extend between the beams 30A, 30B. In a building 10 having multiple floor levels 14, each of the beams 30A, 30B has a dual purpose of forming both a floor structure 18 of a first floor level 14 and a ceiling structure 22 of a second adjacent floor level 14 (FIG. 2B). The beams 30A, 30B may be collectively referred to as the beam 30.

Figure 1E:
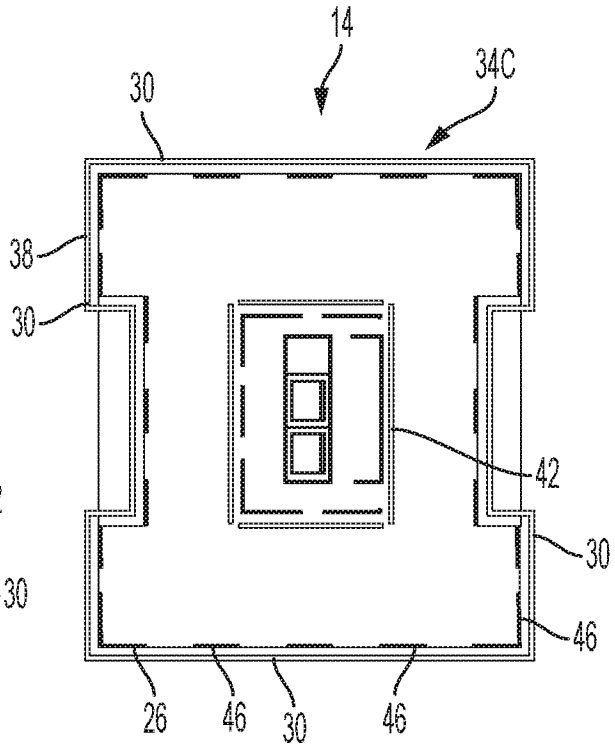
FIG. 1E is a plan view of another floor plan for one of the floor levels of FIG. 1A.
Figure 1D:
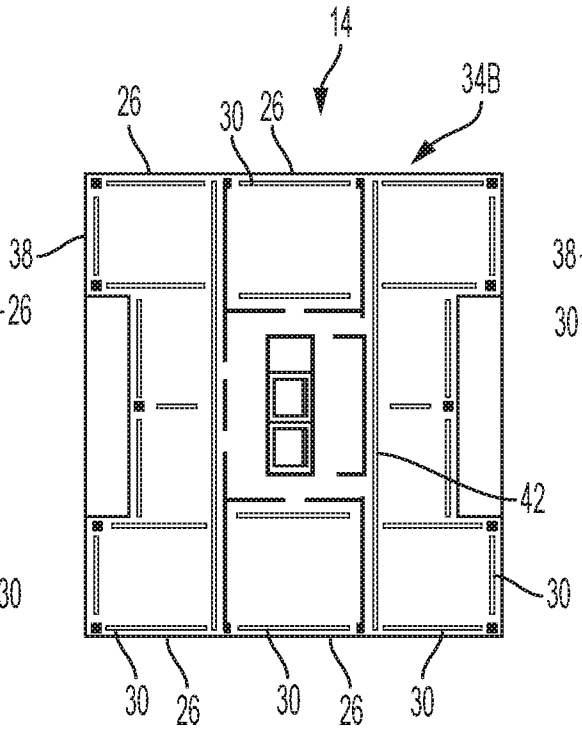
FIG. 1D is a plan view of another floor plan for one of the floor levels of FIG. 1A.
Figure 1C:
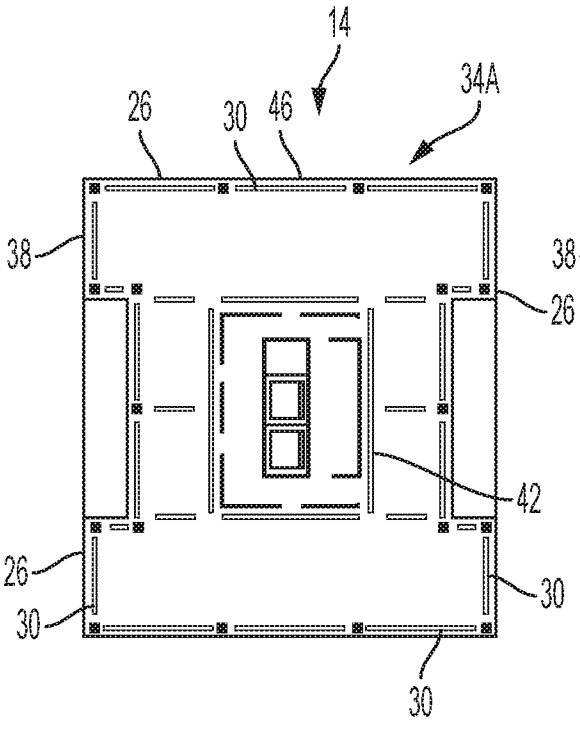
FIG. 1C is a plan view of a floor plan for one of the floor levels of FIG. 1A.

FIGS. 1C-1E illustrate examples of different floor plans 34A-34C that any floor level 14 of a building 10 may have. The beams 30A, 30B are positioned on an outer edge or perimeter 38 of the floor level 14. In addition, the beams 30A, 30B may be positioned at inner areas 42 of the floor level 14. These beams 30A, 30B may be configured to support walls 26 forming rooms of the respective floor level 14. Furthermore, the different walls 26 forming the floor level 14 may be separated into a plurality of wall sections 46 (e.g., see FIG. 1E). These wall sections 46 are formed by wall panels 50, 54. As discussed below, the panels 50 may be "rocking panels" as described herein, and the panels 54 may be rigid panels (relative to the beams 30A, 30B).

With reference again to FIG. 1A, the building 10 may have multiple floor levels 14 in which some of the floor levels 14 include the walls 26 formed by the movably coupled panels 50 (i.e., rocking panels). For example, for the building 10 of FIG. 1A, the walls 26 of the first floor level 14 of the building 10 are all formed by the movably coupled panels 50, and the walls 26 of the remaining seven floor levels 14 above the first floor level 14 are formed by the rigidly coupled panels 54. In another example, for the building 10 of FIG. 1A, the floor levels 14 may alternate between walls 26 formed by the movably coupled panels 50 (e.g., floor levels one, three, five, and seven) and walls 26 formed by the rigidly coupled panels 54 (e.g., floor levels two, four, six, and eight). Still further, in another example, for the building 10 of FIG. 1A, the walls 26 of every fourth floor level 14 (e.g., the first floor level and the fifth floor level) are formed by the movably coupled panels 50 and the walls 26 of the remaining floor levels 14 are formed by the rigidly coupled panels 54. Further combinations are used in other embodiments.

Figure 2A:
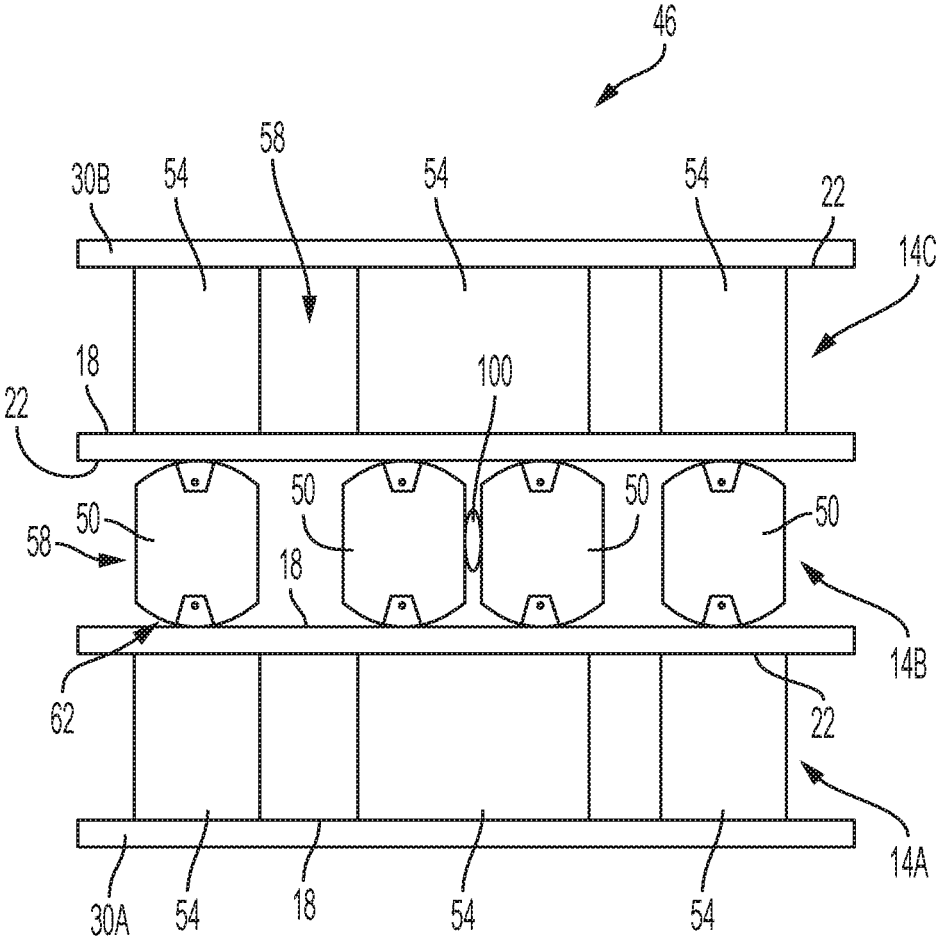
FIG. 2A is an elevation view of multiple floor levels such as the floor levels of FIG. 1A, illustrating the second floor level having walls formed by rocking panels.
Figure 2B:
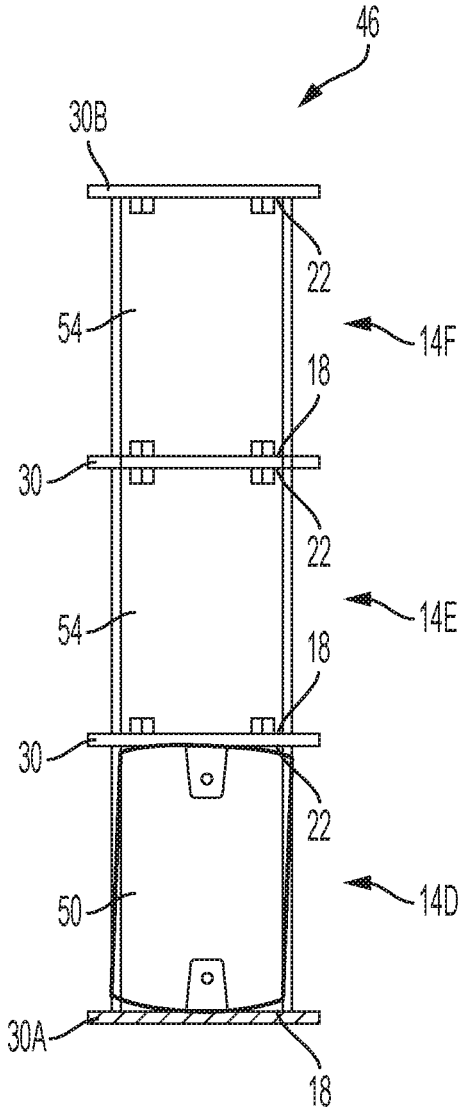
FIG. 2B is another elevation view of multiple floor levels such as the floor levels of FIG. 1A, illustrating the first floor level having walls formed by rocking panels

FIGS. 2A and 2B illustrate the panels 50, 54 positioned along a portion of the wall section 46. Gaps 58 (FIG. 2A) may be formed between adjacent panels 50, 54. Windows and/or doors may be positioned within these gaps 58. The gaps 58 may also provide space for the panels 50 to move or "rock" into, in particular at corners of adjoining walls 26 of the building 10. The panels 54 forming the plurality of wall sections 46 may be rigidly coupled to the beam 30B of the ceiling structure 22 and the beam 30A of the floor structure 18 (i.e., preventing movement between the panel 54 and the beam 30). For example, as shown in FIG. 2A, each panel 54 of the first floor level 14A and the third floor level 14C are rigidly coupled to the ceiling structure 22 and the floor structure 18 of the respective floor level 14A, 14C. In another example, as shown in FIG. 2B, the panel 54 of each of the second and third floor levels 14E, 14F are rigidly coupled to the ceiling structure 22 and the floor structure 18. The panels 54 may be rigidly coupled such as by fasteners, welding, etc.

Figure 3A:
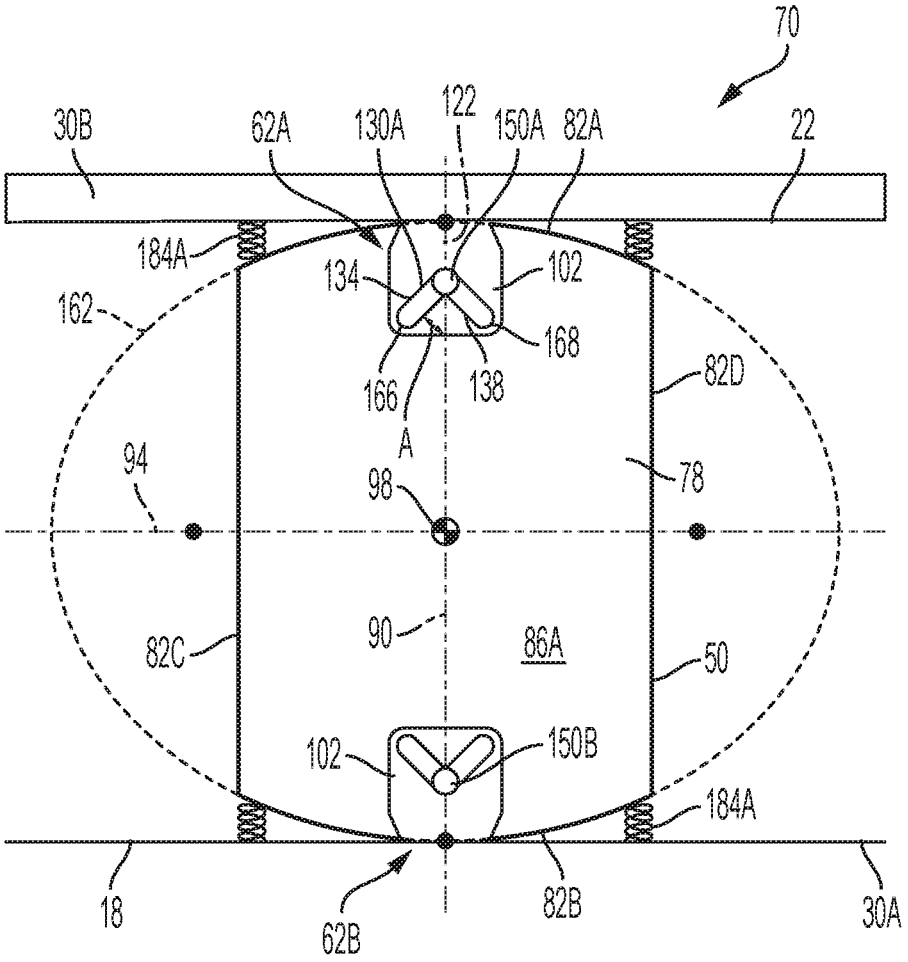
FIG. 3A is an elevation view of a panel assembly including one of the rocking panels of FIG. 2A or 2B, illustrating a V-shaped slot and the rocking panel in a resting configuration.

In contrast, the panels 50 may be movably coupled to the beam 30B of the ceiling structure 22 and the beam 30A of the floor structure 18. More specifically, a top of one of the panels 50 is movably coupled to the ceiling structure 22 by a wall connector assembly 62A (FIG. 3A). In addition, a bottom of the panel 50 is movably coupled to the floor structure 18 by another wall connector assembly 62B. In one embodiment, as shown in FIG. 2A, each panel 50 of the second floor level 14B is movably coupled by the wall connector assembly 62 to the ceiling structure 22 and the floor structure 18 of the second floor level 14B. In another embodiment, as shown in FIG. 2B, the panel 50 of the first floor level 14D is movably coupled by the wall connector assembly 62 to the ceiling structure 22 and the floor structure 18 of the first floor level 14D. In other embodiments, one or more wall sections 46 include a combination of one or more rocking panels 50 and rigid panels 54.

With reference to FIG. 3A, each rocking panel 50 forms a portion of a panel assembly 70. The panel assembly 70 includes the panel 50, a first wall connector assembly 62A for connecting the panel 50 to the ceiling structure 22 (i.e., upper beam 30B), and a second wall connector assembly 62B for connecting the panel 50 to the floor structure 18 (i.e., lower beam 30A). The panel 50 includes a body 78 having a plurality of edges 82A-82D. The illustrated body 78 has a first edge 82A, a second edge 82B, a third edge 82C, and a fourth edge 82D forming a generally rectangular shape, except with curved top and bottom edges 82A, 82B. The second edge 82B is opposite the first edge 82A, and the fourth edge 82D is opposite the third edge 82C. Furthermore, the first edge 82A is in facing relationship with the ceiling structure 22, and the second edge 82B is in facing relationship with the floor structure 18. The first edge 82A and the second edge 82B is further configured to contact the ceiling structure 22 and the floor structure 18 (i.e., the beam 30 forming the structure 18, 22), respectively. The first edge 82A and the second edge 82B each have a curvilinear shape. As such, only a portion of each of the first edge 82A and the second edge 82B contacts the respective structure 22, 18 during movement of the panel 50 relative to the floor structure 18 and the ceiling structure 22.

The body 78 of the panel 50 includes a first side 86A and a second side 86B opposite the first side 86A (only one of which is shown in FIG. 3A). The first side 86A and the second side 86B extend between the plurality of edges 82A-82D. The first side 86A and the second side 86B may form the inner and/or outer walls 26 of the building 10. Furthermore, the body 78 is formed of a material. In the illustrated embodiment, the body 78 is formed of cross-laminated timber. In other embodiments, the body 78 is formed of other types of wood such as laminated veneer lumber (LVL), mass plywood, etc. Still further, in other embodiments, the body 78 may be formed by other materials such as reinforced concrete, cold-formed steel, hot-rolled steel, or other construction materials.

The body 78 includes a first axis 90 that is perpendicular to and extends through the first edge 82A and the second edge 82B of the body 78. A second axis 94 of the body 78 is perpendicular to and extends through the third edge 82C and the fourth edge 82D. The first axis 90 and the second axis 94 intersect each other at a center point 98 of the panel 50. As such, the first axis 90 and the second axis 94 each extend through the center of the panel 50, and extend parallel to or along a plane formed by the first side 86A (or the second side 86B).

Figure 4A:
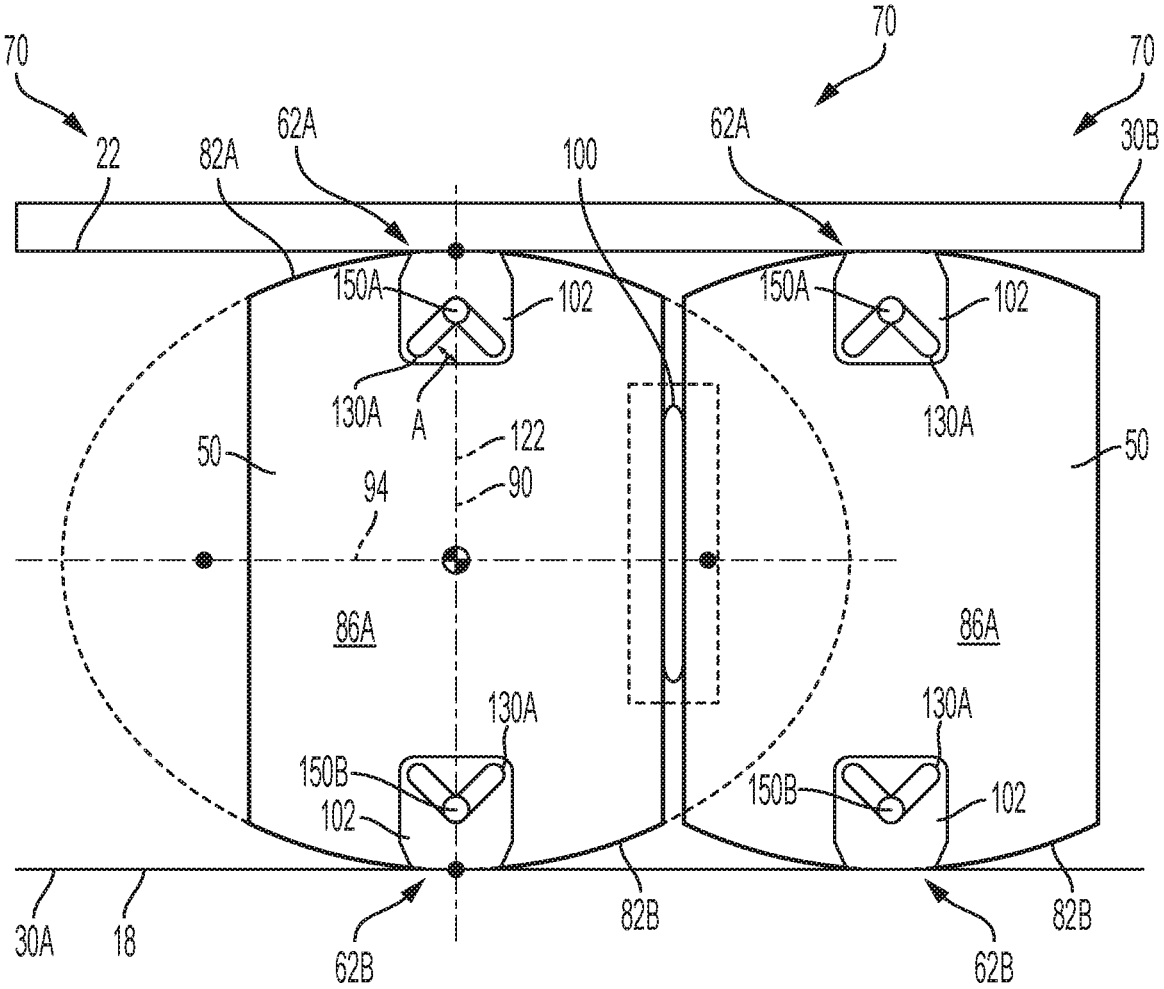
FIG. 4A is an elevation view of a panel assembly including two rocking panels coupled for movement together, illustrating the two rocking panels in a resting configuration.
Figure 4B:
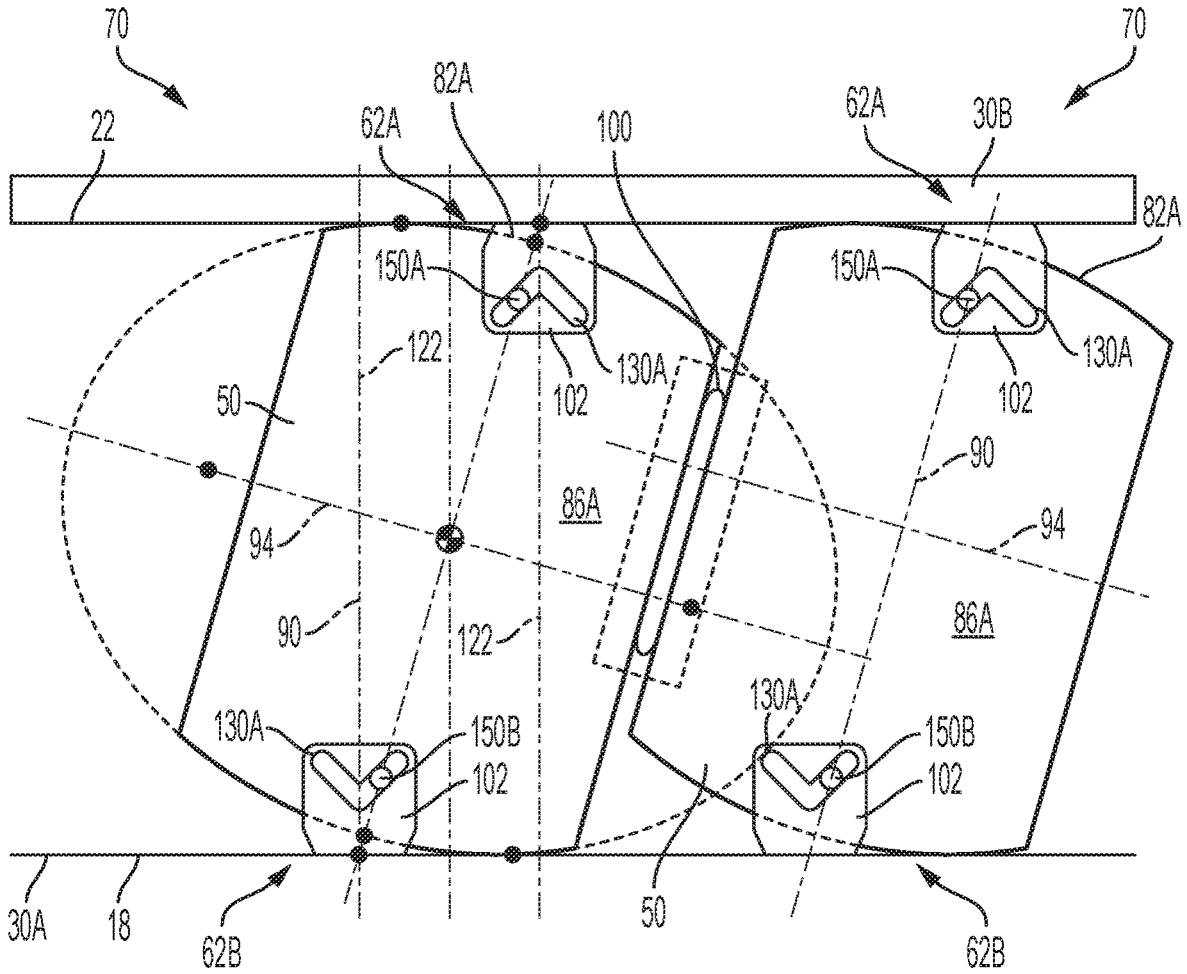
FIG. 4B is an elevation view of the panel assembly of FIG. 4A, illustrating the two rocking panels in a rocking configuration.

With reference to FIGS. 2A and 4A-4B, adjacent rocking panels 50 forming the different wall sections 46 may be coupled to each other. In the illustrated embodiment, the adjacent rocking panels 50 are coupled together by a dissipation device 100 as prescribed in U.S. Pat. No. 8,935,892, the contents of which are incorporated herein by reference. As such, the adjacent rocking panels 50 may be coupled for movement together (FIG. 4B). Alternatively, the adjacent rocking panels 50 do not need to be coupled together, as shown in FIG. 2A.

Figure 8:
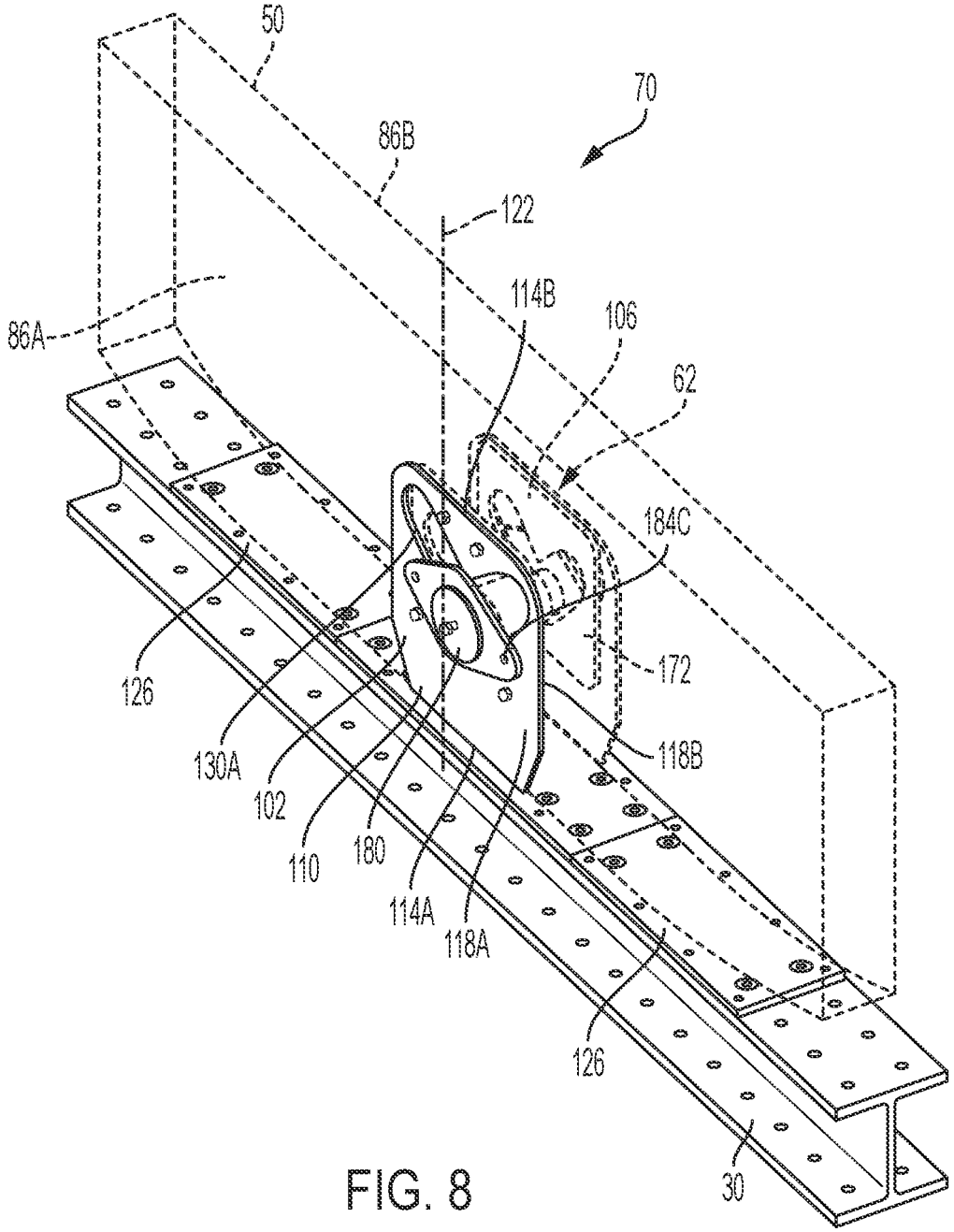
FIG. 8 is a perspective view of a wall connector assembly and a portion of the rocking panel of FIG. 3A.

FIG. 8 illustrates a wall connector assembly 62, which may be used as the wall connector assembly 62A, 62B (see FIG. 3A). Each wall connector assembly 62 includes a first face plate 102 and a second face plate 106. Each face plate 102, 106 has a body 110 and a plurality of edges 114A, 114B. The illustrated body 110 has at least a first edge 114A and a second edge 114B and forms a generally rectangular shape. In other embodiments, each face plate 102, 106 may have another shape such as trapezoidal (see FIG. 11), etc. The first edge 114A is positioned adjacent the beam 30 of the floor structure 18 or the ceiling structure 22, and the second edge 114B is opposite the first edge 114A. In other words, the second edge 114B is positioned farther from the floor structure 18 or the ceiling structure 22 than the first edge 114A.

The body 110 of each face plate 102, 106 includes a first side 118A (FIG. 8) and a second side 118B opposite the first side 118A. The first side 118A and the second side 118B extend between the plurality of edges 114A, 114B. A center axis 122 of the body 110 is perpendicular to and extends through the first edge 114A and the second edge 114B, and through a center of the respective face plate 102, 106. The face plate 102, 106 is positioned relative to the panel 50 such that the center axis 122 is aligned with the first axis 90 of the panel 50 (FIG. 3A). Furthermore, the body 110 of each face plate 102, 106 is formed of a rigid material, such as metal (e.g., steel).

Figure 11:
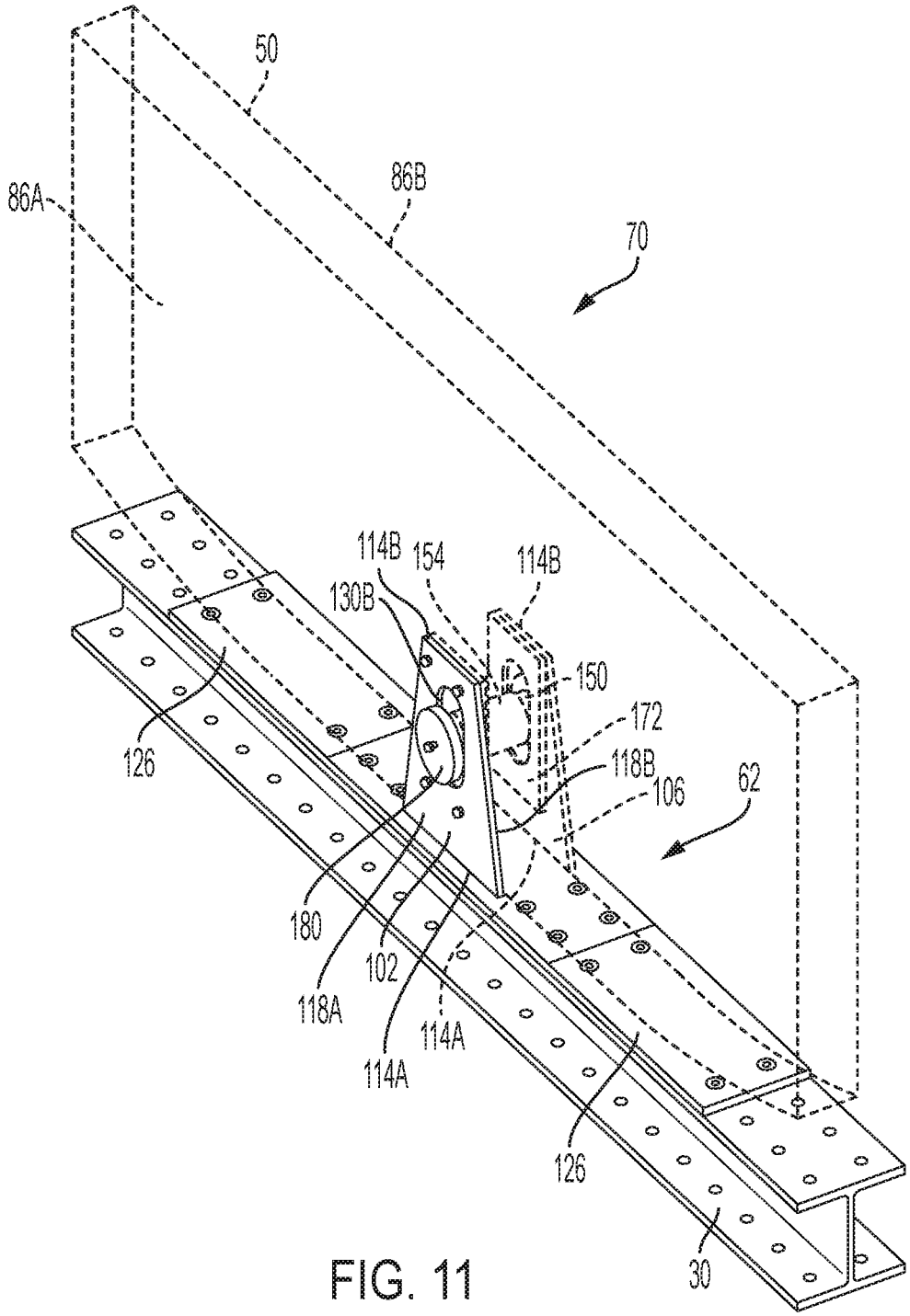
FIG. 11 is a perspective view of a wall connector assembly including the vertical slot, and a portion of the rocking panel of FIG. 10.
Figure 13A:
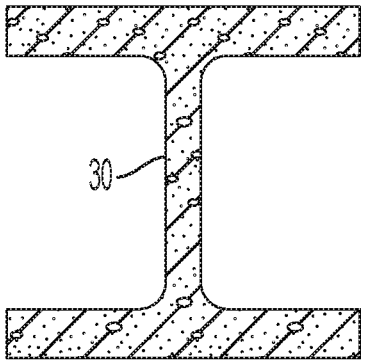
FIG. 13A is a cross-sectional view of a beam forming a floor structure and/or a ceiling structure of one of the floor levels of FIG. 1A.
Figure 13B:
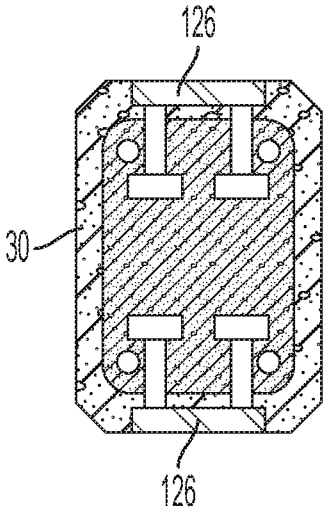
FIG. 13B is a cross-sectional view of another embodiment of a beam forming a floor structure and/or a ceiling structure of one of the floor levels of FIG. 1A.
Figure 14:
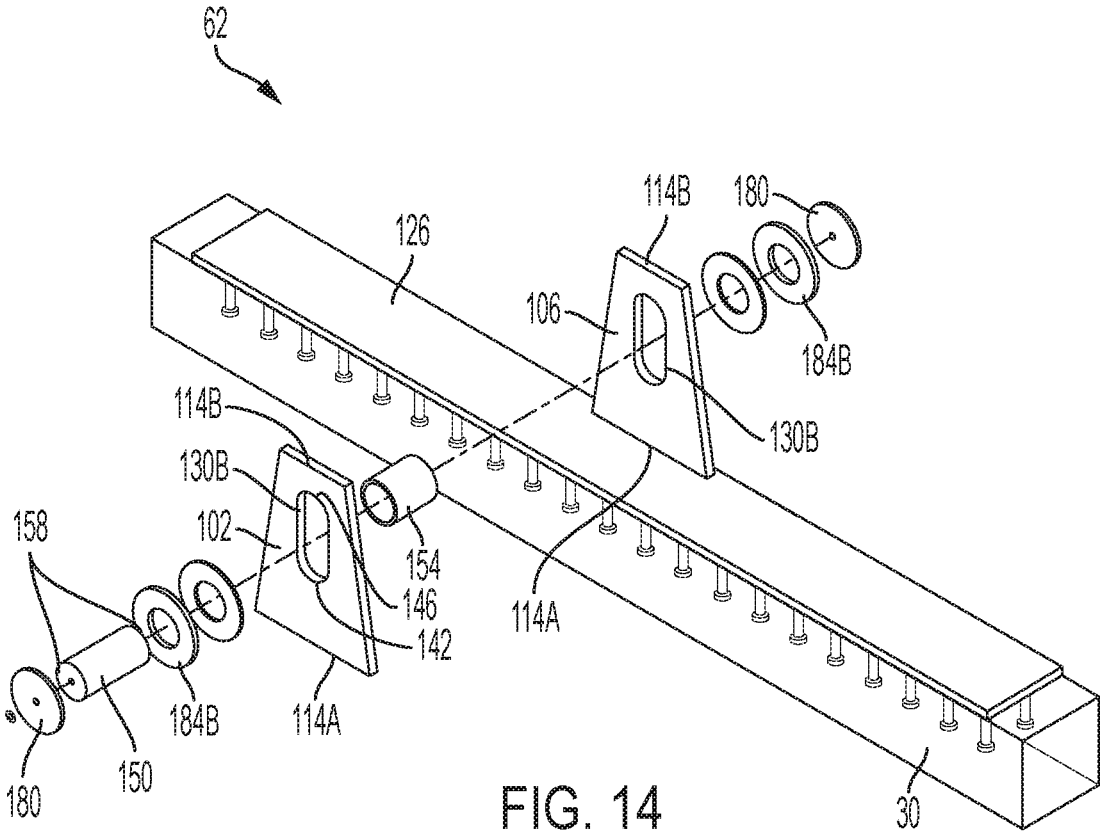
FIG. 14 is an exploded view of the wall connector assembly of FIG. 11 including the beam of FIG. 13B.
Figure 15:
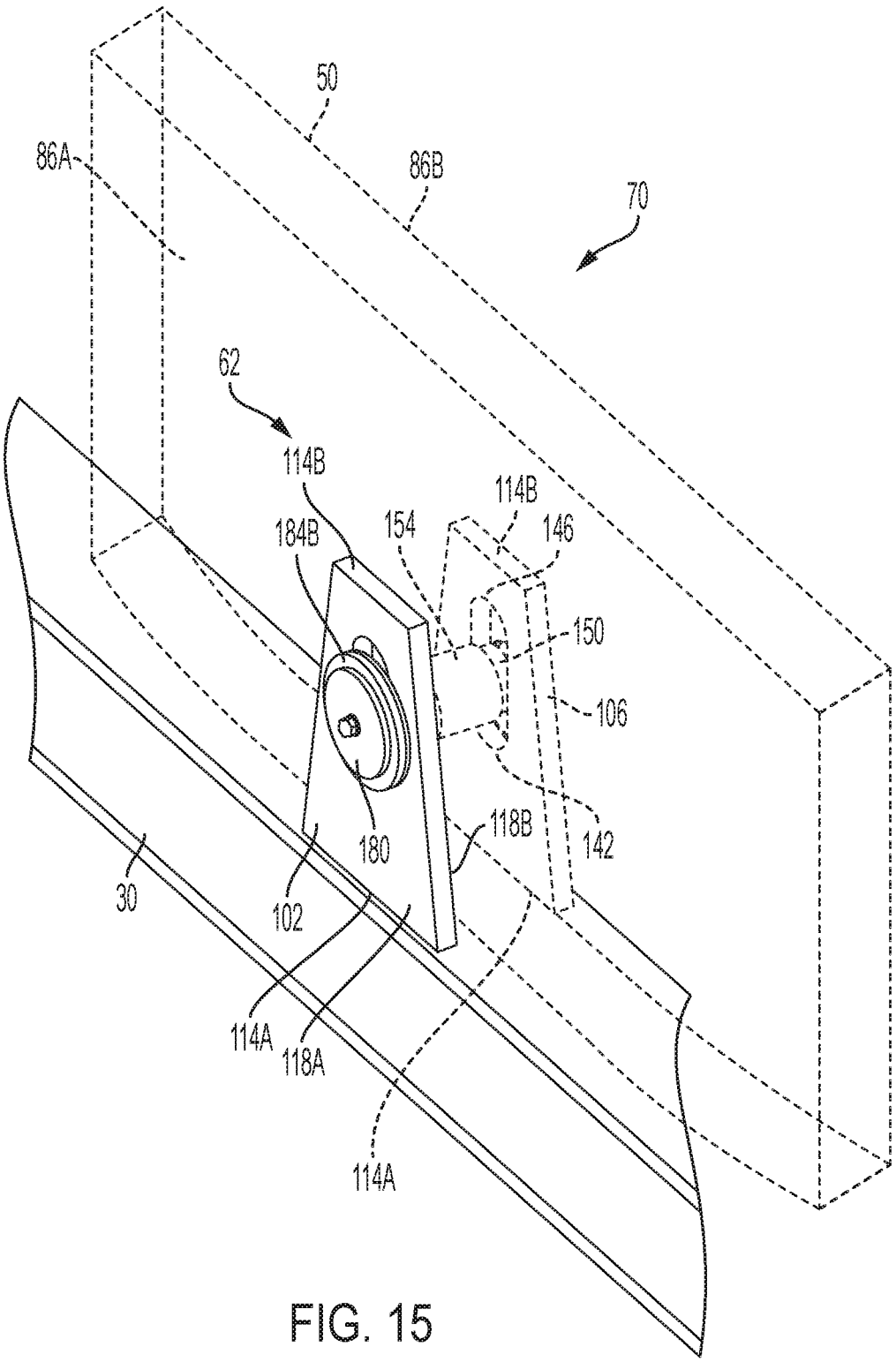
FIG. 15 is a perspective view of another wall connector assembly having the vertical slot, and a portion of the rocking panel of FIG. 10.
Figure 16:
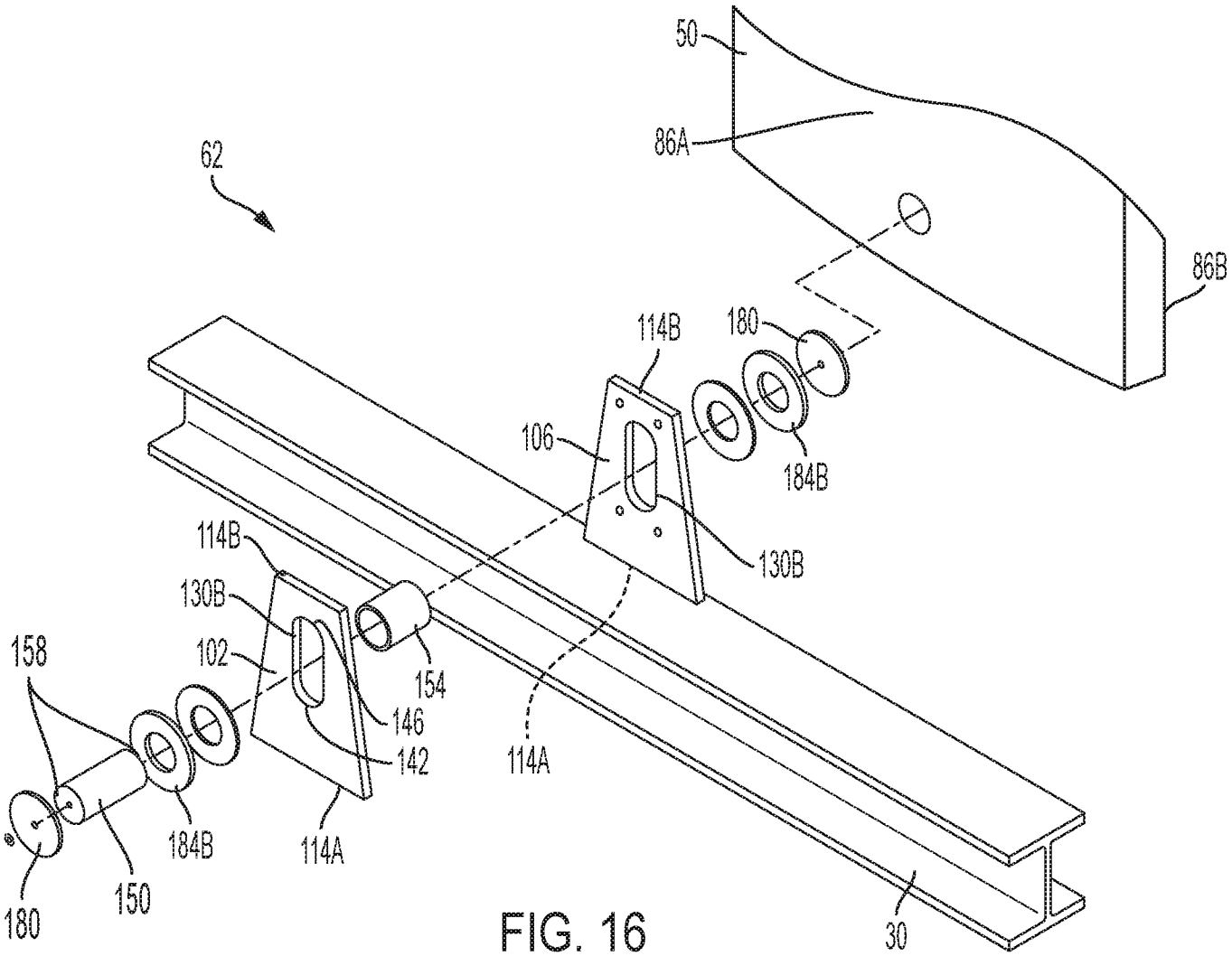
FIG. 16 is an exploded view of the wall connector assembly and the portion of the rocking panel of FIG. 15 illustrating a limiting member of the wall connector assembly.
Figure 17:
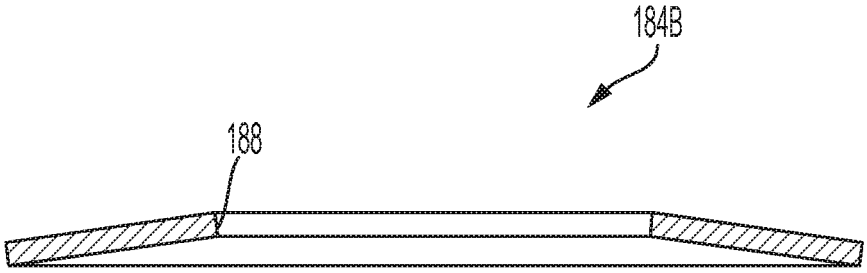
FIG. 17 is a top cross-sectional view of the limiting member of FIG. 16.

Each face plate 102, 106 is rigidly coupled to the beam 30 of the respective structure (i.e., ceiling structure 22, floor structure 18). More specifically, the first edge 114A of the face plate 102, 106 is secured to the beam 30. In one embodiment, as shown in FIG. 13A, the beam 30 has an I-beam shape, and the first edge 114A is secured to a top or a bottom of the I-beam 30 (FIG. 15) such as by welding. In another embodiment, as shown in FIGS. 8 and 11, the first edge 114A of each face plate 102, 106 is secured (e.g., welded) to an intermediate plate 126, such as by welding, and the intermediate plate 126 is secured to the top or the bottom of the I-beam 30 by fasteners. Still further, in other embodiments, as shown in 13B, the beam 30 has a rectangular shape, and the intermediate plate 126 is positioned (i.e., embedded) within the beam 30. In this embodiment, fasteners may be used to further secure the intermediate plate 126 to the beam 30. The I-beam 30 may be formed by metal such as steel. The rectangular beam 30 may be formed by concrete, and the intermediate plate 126 a may be formed by metal such as steel.

Furthermore, with reference to FIG. 8, each face plate 102, 106 is positioned on one of the first side 86A and the second side 86B of the panel 50. For example, the first face plate 102 is positioned on the first side 86A of the panel 50. The second face plate 106 is positioned on the opposite second side 86B of the panel 50. The first and second face plates 102, 106 are in facing relationship with the first and second sides 86A, 86B of the panel 50.

Figure 9:
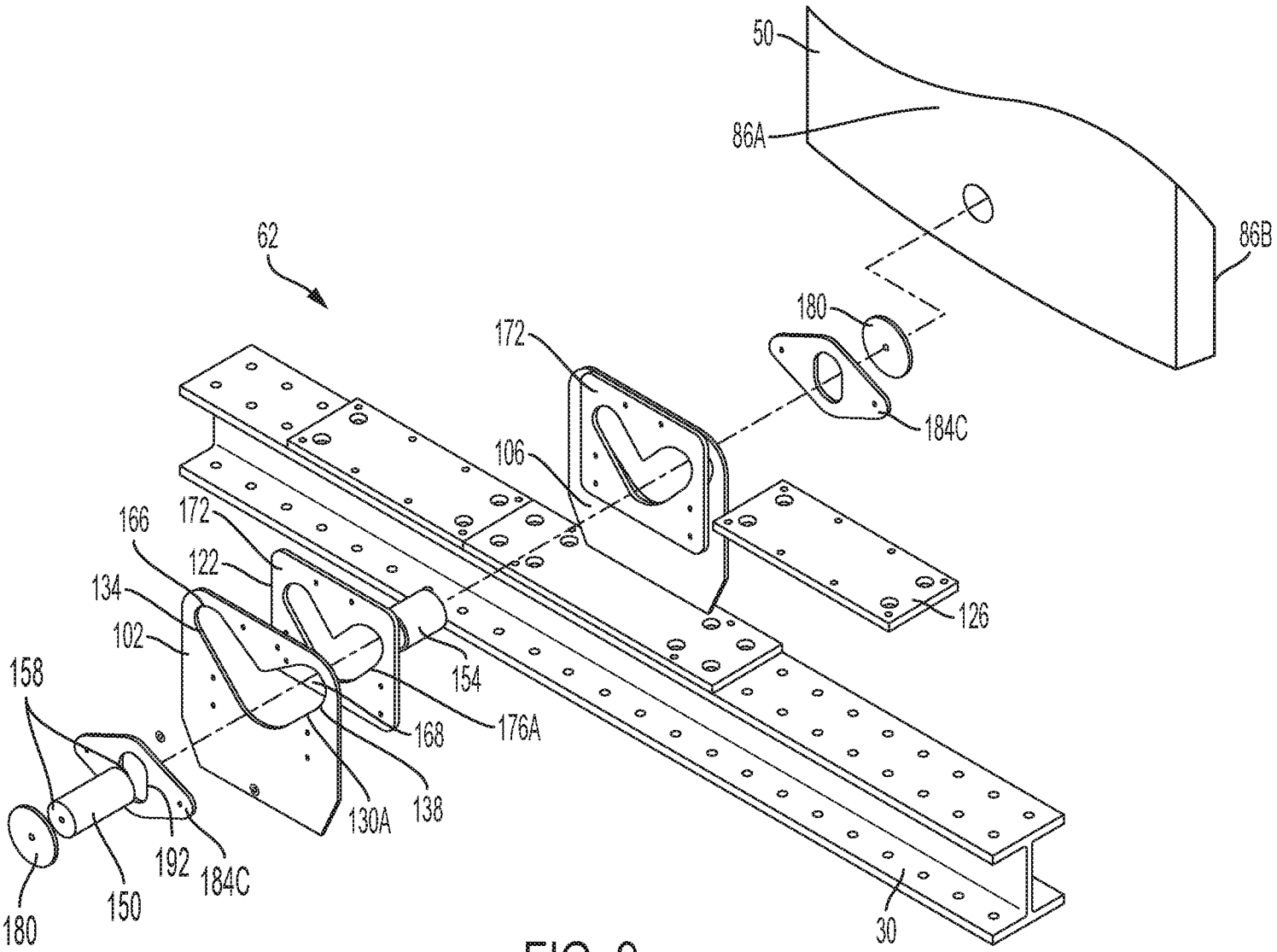
FIG. 9 is an exploded view of the wall connector assembly and the portion of the rocking panel of FIG. 8.

Each face plate 102, 106 defines a slot (e.g., slot 130A of FIG. 8 and slot 130B of 11). In one embodiment, as shown in FIGS. 8 and 9, the slot 130A has a shape positioned relative to the center axis 122. More specifically, the slot 130A of each face plate 102, 106 has a substantially "V" shape in which a point of the "V" is positioned on the center axis 122. In this embodiment, the slot 130A includes a first leg portion 134 and a second leg portion 138, each extending at an angle A relative to the center axis 122 (FIG. 9). In the illustrated embodiment, the angle A is about 45 degrees. The first leg portion 134 and the second leg portion 138 extend at the angle A on opposite sides of the center axis 122. Furthermore, the first and second leg portions 134, 138 extend from the point of the "V" away from the first edge 114A of the respective face plate 102, 106 toward the second edge 114B at the angle A. As such, this type of slot 130A may be termed as the "V-shaped slot."

With continued reference to FIGS. 8-9, the wall connector assembly 62 includes a pin 150. The pin 150 is coupled to the panel 50. In the illustrated embodiment, the pin 150 is coupled to the panel 50 in part by a bushing 154. Specifically, the pin 150 extends through the panel 50 from the first side 86A to the second side 86B. Each end portion 158 (FIG. 9) of the pin 150 is received in the respective slot 130A of the first face plate 102 or the second face plate 106. Therefore, the first and second face plates 102, 106 and the respective slots 130A support the pin 150 on either side 86A, 86B of the panel 50. With respect to the panel assembly 70 (e.g., FIG. 3A), the panel 50 includes two of the pins 150: a first pin 150A for one of the wall connector assembly 62A, and a second pin 150B spaced from the first pin 150A on the panel 50 for the other of the wall connector assembly 62B.

The pin 150 is configured to move relative to the first face plate 102 and the second face plate 106 within the respective slot 130A with the movement of the panel 50. More specifically, when seismically induced forces are applied to the building 10, the panels 50 receive the seismically induced forces, and the pins 150, coupled to the panels 50, move in the respective slots 130A to decouple and/or isolate the respective walls 26 (i.e., the wall sections 46) from the rigid structure of the building 10. The movement of the panels 50 may also or further allow these seismically induced forces to be re-directed.

Figure 5A:
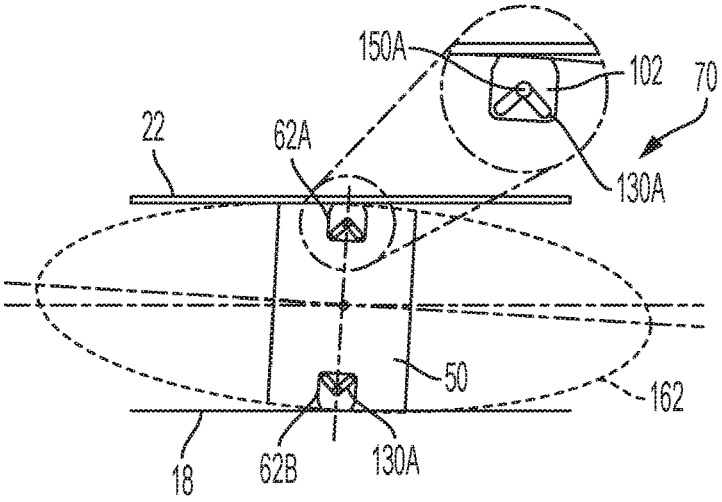
FIG. 5A is an elevation view of the panel assembly of FIG. 3A, illustrating a first elliptical path the rocking panel follows and a V-shaped slot.
Figure 5B:
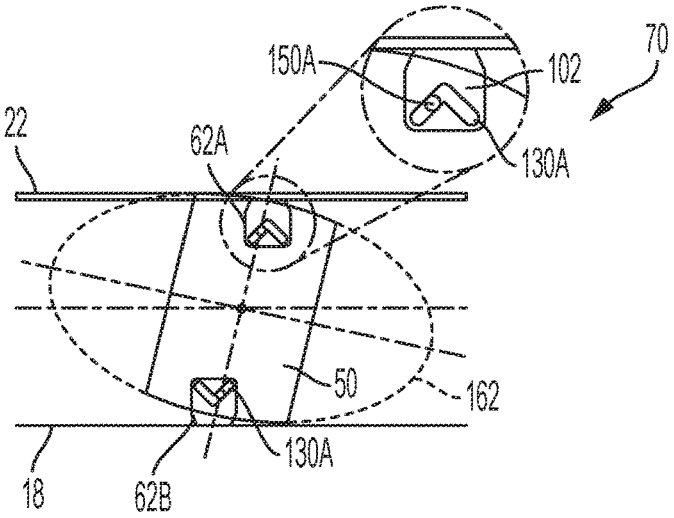
FIG. 5B is an elevation view of the panel assembly of FIG. 3A, illustrating a second elliptical path the rocking panel follows and a V-shaped slot.
Figure 5C:
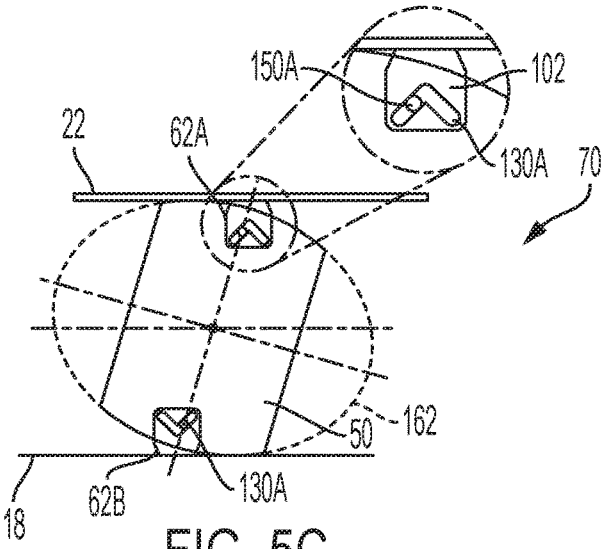
FIG. 5C is an elevation view of the panel assembly of FIG. 3A, illustrating a third elliptical path the rocking panel follows and a V-shaped slot.

With reference to FIGS. 5A-5C, the curvilinear shape of the first and second edges 82A, 82B of the panel 50 defines a predetermined path 162 relative to the floor structure 18 and the ceiling structure 22, respectively, which the movement of the panel 50 follows when the seismically induced forces occur. The predetermined path 162 has an elliptical shape and extends on either side of the center axis 122. The shape of the slot 130A corresponds to the curvilinear shape of the first and second edges 82A, 82B of the panel 50. The pins 150 (i.e., end portions 158) are movable within the respective slots 130A for guiding the movement of the panel 50 along the predetermined path 162.

More specifically, the curvilinear shape of the first and second edges 82A, 82B of the panel 50 cause the panel 50 to move in a "rocking motion" (moving to the left and right from the frame of reference of FIGS. 3B and 4B) when the seismically induced forces are applied. In other words, the seismically induced forces cause the panel 50 to move in a first direction or a second direction along the predetermined path. Furthermore, the slot 130A limits the movement of the panel 50 along the predetermined path 162 in each direction such that the panel 50 may, for example, move in the first direction, then in the second direction, and then return again in the first direction, in response to the seismically induced forces, thereby creating the rocking motion of the panel 50. Said another way, the movement of each panel 50 along the predetermined path 162 may be defined as cyclic displacement. The panels 50 are configured to move along the predetermined path 162 for many cycles such that the predetermined path 162 may be defined as a pendulum path.

For example, with reference to FIG. 3A, an end 166 of the first leg portion 134 and an end 168 of the second leg portion 138 of the V-shaped slot 130A prevents continued movement of the panel 50 in a respective direction along the predetermined path 162. As the panel 50 follows along the predetermined path 162 in a first direction (i.e., to the right from the frame of reference of the upper portion of the panel 50 in FIGS. 3B and 4B), the opposite left corner of the edge 82A (i.e., opposite right corner of the edge 82B for the bottom portion of the panel 50) contacts the respective structure 22, 18. When the pin 150 reaches the end 166 of the first portion 134, the movement of the panel 50 ceases in that direction. Additionally, the panel 50 follows the predetermined path 162 in the other direction (i.e., to the left from the frame of reference of the upper portion of the panel 50 in FIGS. 3B and 4B), causing the opposite right corner of the edge 82A (i.e., opposite left corner of the edge 82B for the bottom portion of the panel 50) to contact the respective structure 22, 18 until the pin 150 reaches the end 168 of the second portion 138 and the movement of the panel 50 is again ceased in that direction. The panel 50 able to move relative to the floor structure 18 and the ceiling structure 22 in this manner in the "rocking motion" until the seismic event passes. Once the seismic event passes, the seismically induced forces may be alleviated.

Figure 10:
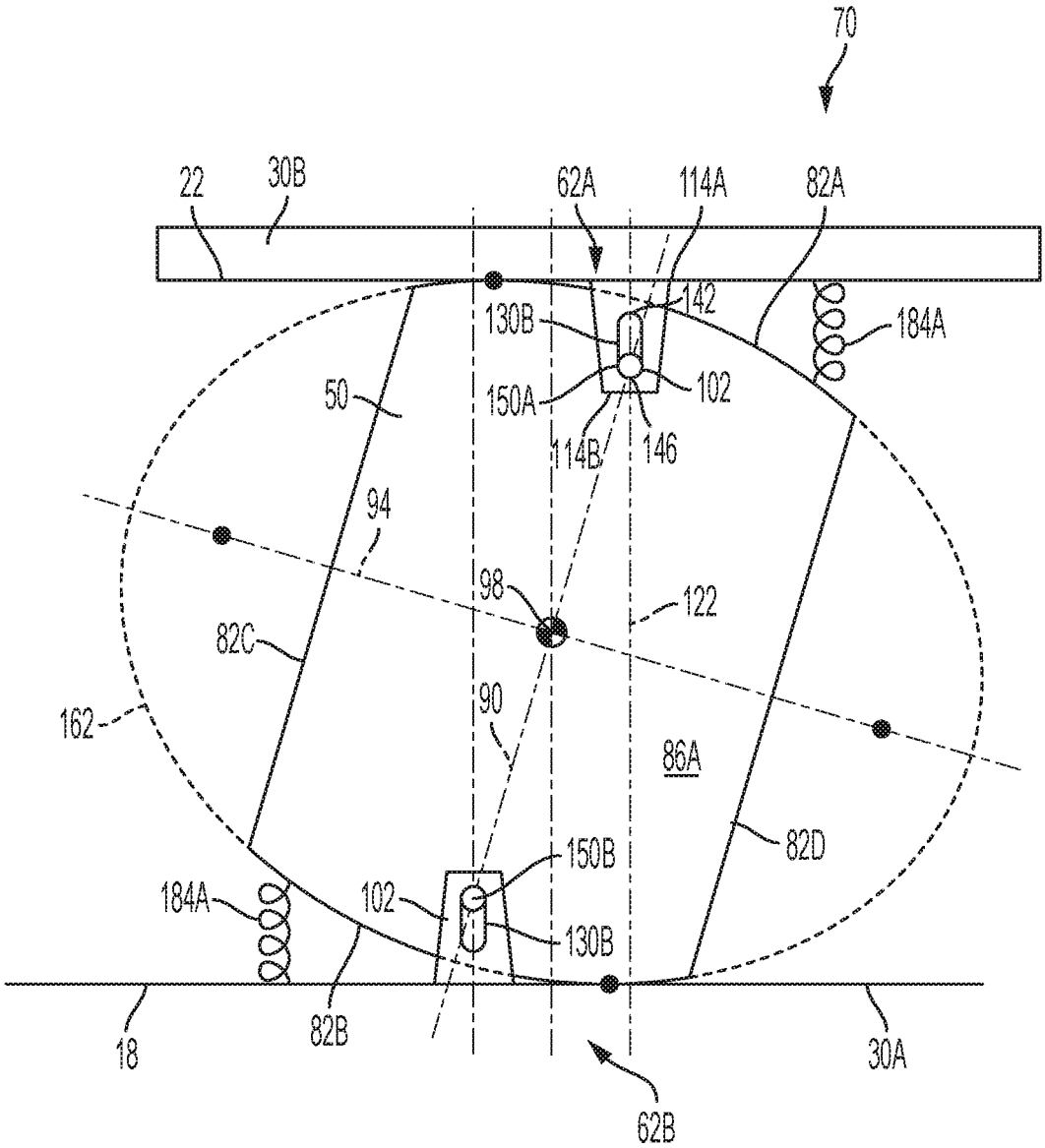
FIG. 10 is an elevation view of a panel assembly including one of the rocking panels of FIG. 2A, illustrating a vertical slot and the rocking panel in a rocking configuration.
Figure 12:
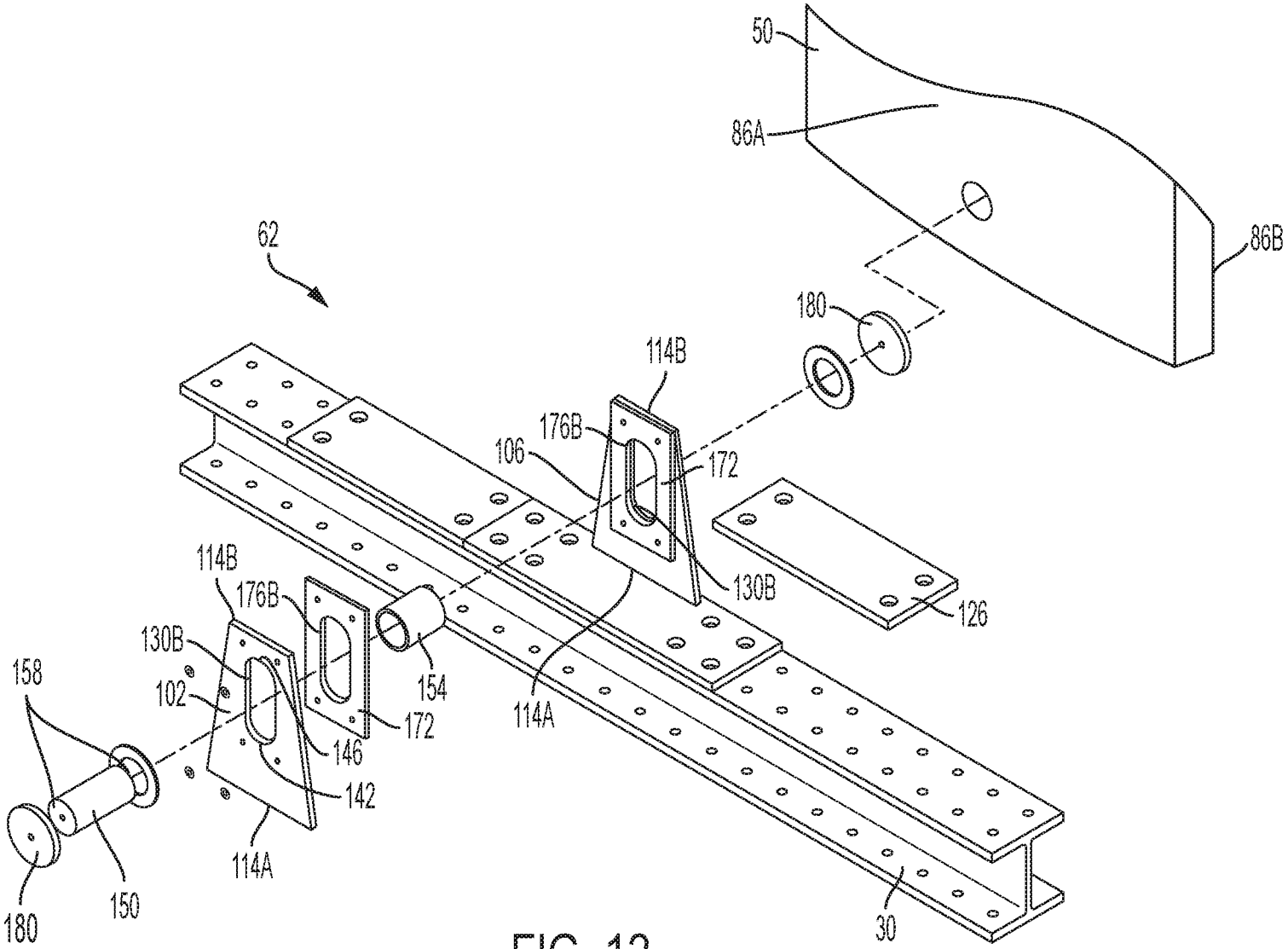
FIG. 12 is an exploded view of the wall connector assembly and the portion of the rocking panel of FIG. 11.

In another embodiment of the wall connector assembly 62, as shown in FIGS. 10-12, the slot 130B has a shape positioned relative to the center axis 122 in which the shape of the slot 130B extends linearly along the center axis 122 from a first end 142 (FIG. 10) to a second end 146 opposite the first end 142. The first end 142 is closer to the first edge 114A of the respective face plate 102, 106 than the second end 146. Additionally, a length of the slot 130B along the center axis 122 is greater than a width of the slot 130B perpendicular to the center axis 122. As such, this type of slot 130B may be termed as the "vertical slot." Like elements as the first embodiment of the wall connector assembly 62 have been given the same name and reference numbers.

With continued reference to FIGS. 11-12, the wall connector assembly 62 includes the pin 150. The pin 150 is coupled to the panel 50. In the illustrated embodiment, the pin 150 is coupled to the panel 50 in part by the bushing 154. Specifically, the pin 150 extends through the panel 50 from the first side 86A to the second side 86B. Each end portion 158 of the pin 150 is received in the respective slot 130B of the first face plate 102 or the second face plate 106. Therefore, the first and second face plates 102, 106 and the respective slots 130B support the pin 150 on either side 86A, 86B of the panel 50. With respect to the panel assembly 70 (e.g., FIG. 10), the panel 50 includes two of the pins 150: a first pin 150A for one of the wall connector assembly 62A, and a second pin 150B spaced from the first pin 150A on the panel 50 for the other of the wall connector assembly 62B.

Similar to the first embodiment of the wall connector assembly, the pin 150 is configured to move relative to the first face plate 102 and the second face plate 106 within the respective slot 130B with the movement of the panel 50. More specifically, when seismically induced forces are applied to the building 10, the panels 50 receive the seismically induced forces, and the pins 150, coupled to the panels 50, move in the respective slots 130B to decouple and/or isolate the respective walls 26 (i.e., the wall sections 46) from the rigid structure of the building 10. The movement of the panels 50 may also or further allow these seismically induced forces to be re-directed.

Figure 7A:
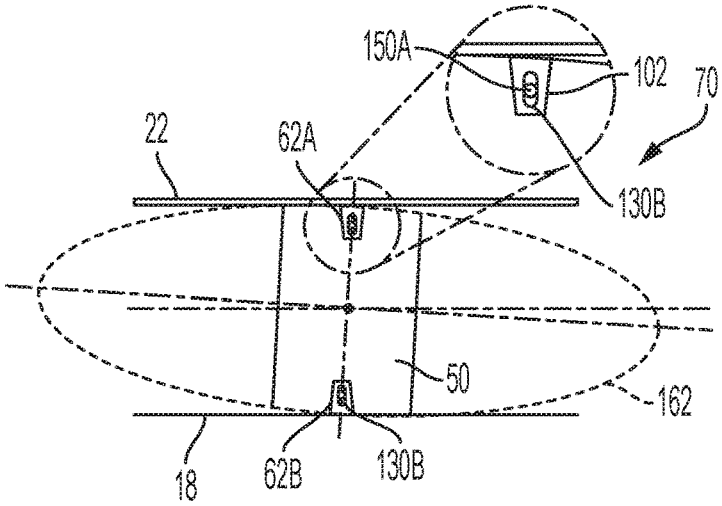
FIG. 7A is an elevation view of the panel assembly of FIG. 3A, illustrating a first elliptical path the rocking panel follows and a vertical slot.
Figure 7B:
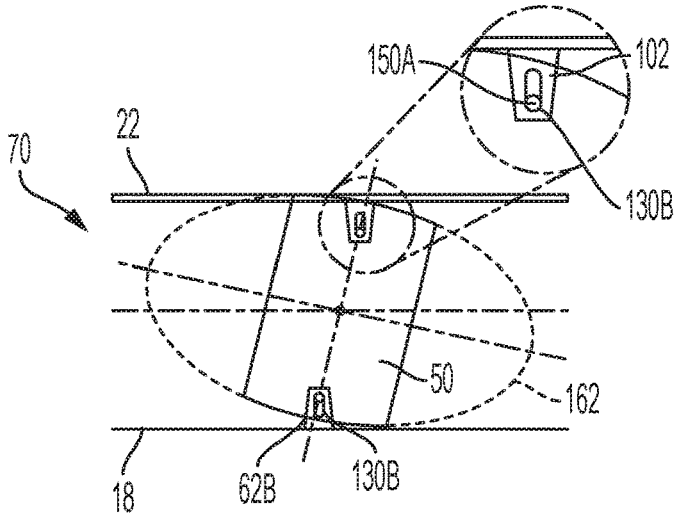
FIG. 7B is an elevation view of the panel assembly of FIG. 3A, illustrating a second elliptical path the rocking panel follows and a vertical slot.
Figure 7C:
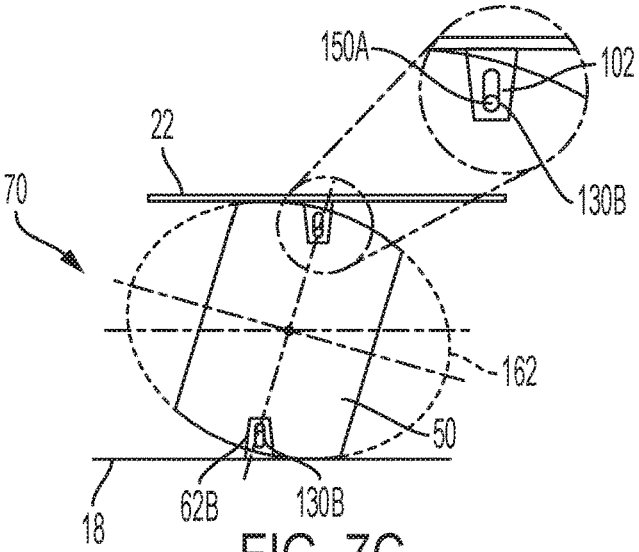
FIG. 7C is an elevation view of the panel assembly of FIG. 3A, illustrating a third elliptical path the rocking panel follows and a vertical slot.

With reference to FIGS. 7A-7C, the curvilinear shape of the first and second edges 82A, 82B of the panel 50 defines a predetermined path 162 relative to the floor structure 18 and the ceiling structure 22, respectively, which the movement of the panel 50 follows when the seismically induced forces occur. The predetermined path 162 has the elliptical shape and extends on either side of the center axis 122. The shape of the slot 130B corresponds to the curvilinear shape of the first and second edges 82A, 82B of the panel 50. The pins 150 (i.e., end portions 158) are movable within the respective slots 130B for guiding the movement of the panel 50 along the predetermined path 162.

More specifically, the curvilinear shape of the first and second edges 82A, 82B of the panel 50 cause the panel 50 to move in a "rocking motion" (moving to the left and right from the frame of reference of FIGS. 3B and 4B) when the seismically induced forces are applied. In other words, the seismically induced forces cause the panel 50 to move in a first direction or a second direction along the predetermined path. Furthermore, the slot 130B limits the movement of the panel 50 along the predetermined path 162 in each direction such that the panel 50 may move in the first direction, then in the second direction, and then return again in the first direction, in response to seismically induced forces, thereby creating the rocking motion of the panel 50. Said another way, the movement of each panel 50 along the predetermined path 162 may be defined as cyclic displacement. The panels 50 are configured to move along the predetermined path 162 for many cycles such that the predetermined path 162 may be defined as a pendulum path.

As shown in FIGS. 10 and 12, the first end 142 and the second end 146 (FIG. 12) of the slot 130B prevent continued movement of the panel 50 in a respective direction along the predetermined path 162. As the panel 50 follows along the predetermined path 162 in a first direction (i.e., to the right from the frame of reference of the upper portion of the panel 50 in FIG. 10), the opposite left corner of the edge 82A (i.e., opposite right corner of the edge 82B for the bottom portion of the panel 50) contacts the respective structure 22, 18. When the pin 150 reaches the second end 146, the movement of the panel 50 ceases in that direction. Additionally, the panel 50 follows the predetermined path 162 in the other direction (i.e., to the left from the frame of reference of the upper portion of the panel 50 in FIG. 10), causing the opposite right corner of the edge 82A (i.e., opposite left corner of the edge 82B for the bottom portion of the panel 50) to contact the respective structure 22, 18 until the pin 150 reaches the first end 142 and the movement of the panel 50 is again ceased in that direction. Similar to the previous embodiment with the V-shaped slot, the panel 50 is able to move relative to the floor structure 18 and the ceiling structure 22 in this manner in the "rocking motion" until the seismic event passes. Once the seismic event passes, the seismically induced forces may be alleviated.

Regarding both embodiments of the wall connector assembly 62 having the V-shaped slots 130A and the vertical slots 130B, the curvilinear shape of the first and second edges 82A, 82B of the panel 50 and the shape of the slot 130A, 130B cause the panel 50 to roll relative to the floor structure 18 and the ceiling structure 22. Furthermore, in the embodiment of the vertical slot 130B, the shape of the slot 130B causes the panel 50 to also slide relative to the floor structure 18 and the ceiling structure 22. In other words, the position of the pin 150 at the first end 142 or the second end 146 causes the first edge 82A and the second edge 82B of the panel 50 to slide (i.e., by slip friction) relative to the floor structure 18 and the ceiling structure 22.

Figure 6A:
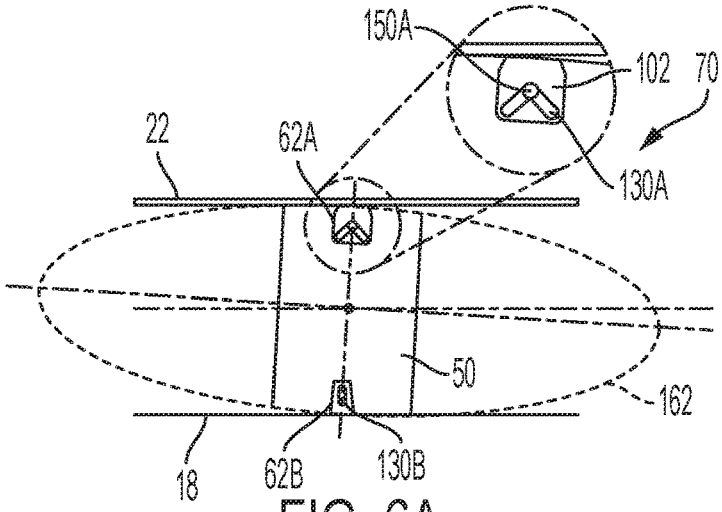
FIG. 6A is an elevation view of the panel assembly of FIG. 3A, illustrating a first elliptical path the rocking panel follows, a V-shaped slot, and a vertical slot.
Figure 6B:
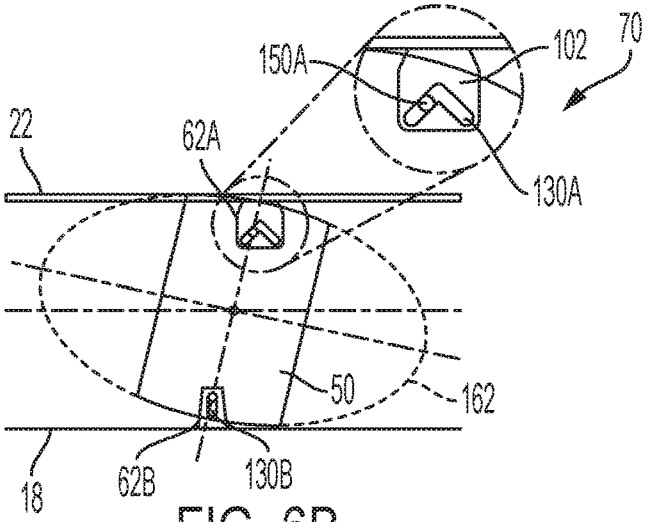
FIG. 6B is an elevation view of the panel assembly of FIG. 3A, illustrating a second elliptical path the rocking panel follows, a V-shaped slot, and a vertical slot.
Figure 6C:
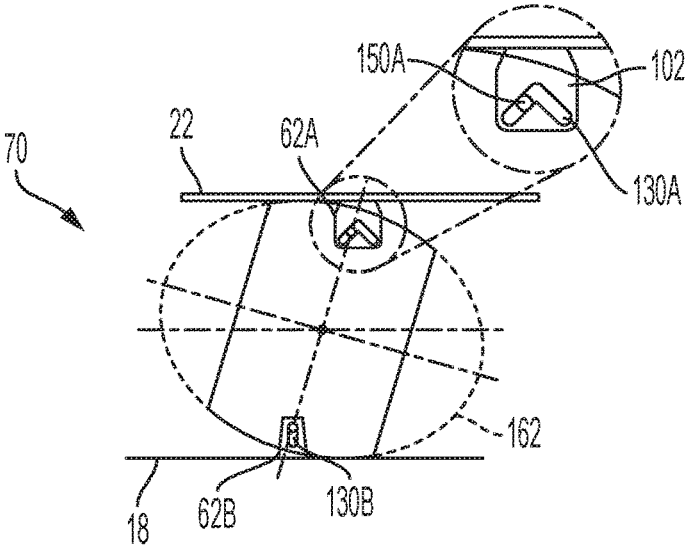
FIG. 6C is an elevation view of the panel assembly of FIG. 3A, illustrating a third elliptical path the rocking panel follows, a V-shaped slot, and a vertical slot.

With particular reference to FIGS. 6A-6C, the panel assembly 70 may include both of the V-shaped slot 130A at one end, and the vertical slot 130B at the opposite end of the panel 50. For example, the first wall connector 62A assembly movably coupling the panel 50 to the ceiling structure 22 has the V-shaped slot 130A, and the second wall connector assembly 62B movably coupling the panel 50 to the floor structure 18 has the vertical slot 130B. In other embodiments, the configuration may be flipped such that the wall connector assembly 62A movably coupling the panel 50 to the ceiling structure 22 has the vertical slot 130B, and the wall connector assembly 62B movably coupling the panel 50 to the floor structure 18 has the V-shaped slot 130A.

Furthermore, as shown in FIGS. 5A-7C, the dimensions (e.g., a height, a length) of the shape of the slot 130A, 130B correspond to a size of the panel 50. For example, the panel 50 has a width B (from the frame of reference of FIGS. 3A and 4A). A length of the first portion 134 and a length of the second portion 138, or a length of the vertical slot 130B along the center axis 122, is increased when the width B of the panel 50 increases. In addition, a size of the elliptical shape of the predetermined path 162 is also increased to accommodate the additional length. As such, the dimensions of the slot shape is proportional to the size of the elliptical shape of the predetermined path 162.

In some embodiments, the shape of the slot (e.g., the V-shaped slot 130A) of the wall connector assembly 62 is determined by (a) determining the position (e.g., the x-coordinate and y-coordinate) of the pin 150 relative to the center point 98 of the panel 50, and (b), tracing the movement of the pin 150 corresponding to the curvilinear shape of the first and second edges 82A, 82B of the panel 50. In some embodiments, the x-coordinate (i.e., "u") and the y-coordinate (i.e., "v") are determined by the equations 1 and 2, respectively, shown below.

$$u = a\int_0^{\theta}\sqrt{1-e^2\sin^2\varphi}\,d\varphi - a\sin\theta\cos\theta_r + b\left(\cos\theta - \frac{d}{b}\right)\sin\theta_r; \quad (1)$$

-continued $$v = a\sin\theta\sin\theta_r + b\cos\theta_r\left(\cos\theta - \frac{d}{b}\right); \quad (2)$$

$$\int_0^{\theta}\sqrt{1 - e^2\sin^2\varphi}\, d\varphi; \quad (3)$$

$$\theta_r = \tan^{-1}\left(\frac{b}{a}\tan\theta\right); \quad (4)$$

$$e = \sqrt{1 - \frac{b^2}{a^2}} \quad (5)$$

Figure 19:
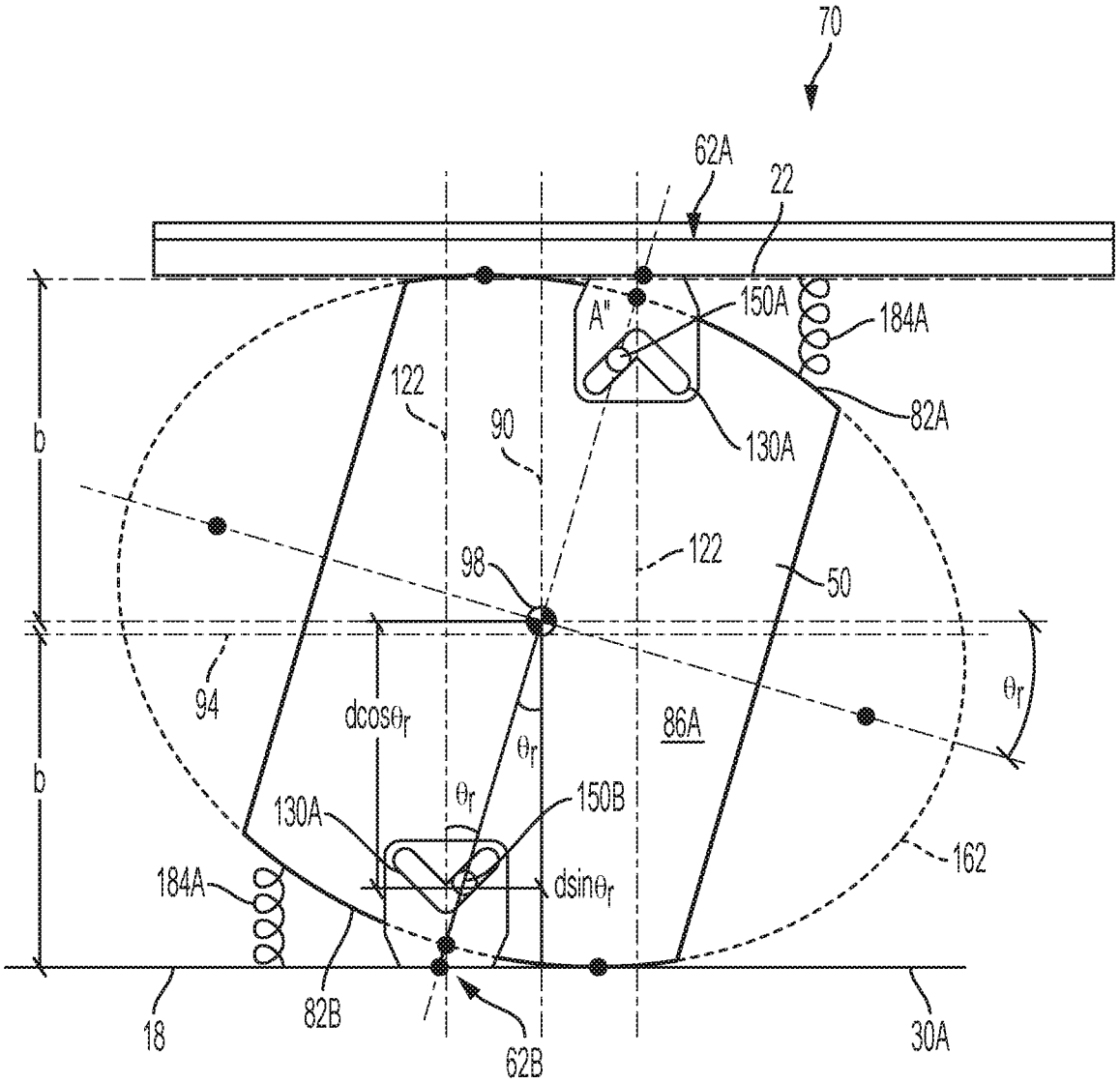
FIG. 19 is another elevation view of the panel assembly of FIG. 3A, illustrating variables used to determine the shape of the V-shaped slot of FIG. 3A based on the elliptical path of FIG. 5A.

In particular, equations 1 and 2 trace a path for the slot 130 (e.g., the v-shaped slot 130A) in Cartesian coordinates: where u is the x-coordinate and v is the y-coordinate. Furthermore, the variables a, b, d, e, and $\theta_r$ are shown in FIG. 19 in which the variable "a" is the semi-major axis width of the elliptical profile, the variable "b" is the semi-minor axis height of the elliptical profile, the variable "d" is the dimension from center of panel (ellipse profile) to center of pin measured along, or with respect to the semi-minor axis of the elliptical profile, and the variable "e" is geometric eccentricity of the ellipse calculated by equation 5. Equation 3, shown above, is an incomplete elliptic integral of the second kind with approximate numerical solutions tabulated or calculated using mathematics software. The variable "$\theta_r$" is the rotation angle of the ellipse profile in which equation 4 relates the rotation angle $\theta_r$ with rotation angle $\theta$ of an auxiliary circle having a radius "a" and a center coinciding with a semi-major axis length and center of the ellipse profile, respectively. In some embodiments different techniques, equations, or both are used to determine the shape of the slot.

With reference to FIGS. 9 and 12, each face plate 102, 106 of the wall connector assembly 62 may be further provided with an auxiliary plate 172. In the embodiment of FIG. 9, the auxiliary plate 172 is a shim plate coupled to the face plate 102, 106 such as by fasteners. The shim plate 172 includes a slot 176A, 176B corresponding to the slot 130A, 130B of the respective face plate 102, 106. As shown in FIG. 9, the slot is a V-shaped slot 176A. As shown in FIG. 12, the slot is a vertical slot 176B. The slot 176A, 176B of the shim plate 172 may have the same or different dimensions then the slot 130A, 130B of the respective face plate 102, 106. The shim plate 172 may be interchangeable with other shim plates 172 having the same or different sized slots 176A, 176B. The shim plate 172 is configured to provide rigidity to the face plate 102, 106 and/or provide support to the end portion 158 of the pin 150 received in the slot 130A, 130B.

With reference to FIGS. 8 and 11, each embodiment of the wall connector assembly 62 includes an end cap 180 positioned on each end portion 158 of the pin 150. In the illustrated embodiment, the end cap 180 is secured to each end portion 158 of the pin 150 by a fastener (see FIGS. 9 and 12, respectively). The end cap 180 may be configured to further limit the movement of the panel 50 in a forward or rearward direction (i.e., along a longitudinal axis defined by the pin 150 from the frame of reference of FIGS. 8 and 11) which is perpendicular to the center axis 122 (e.g., see FIG. 8).

Figure 3B:
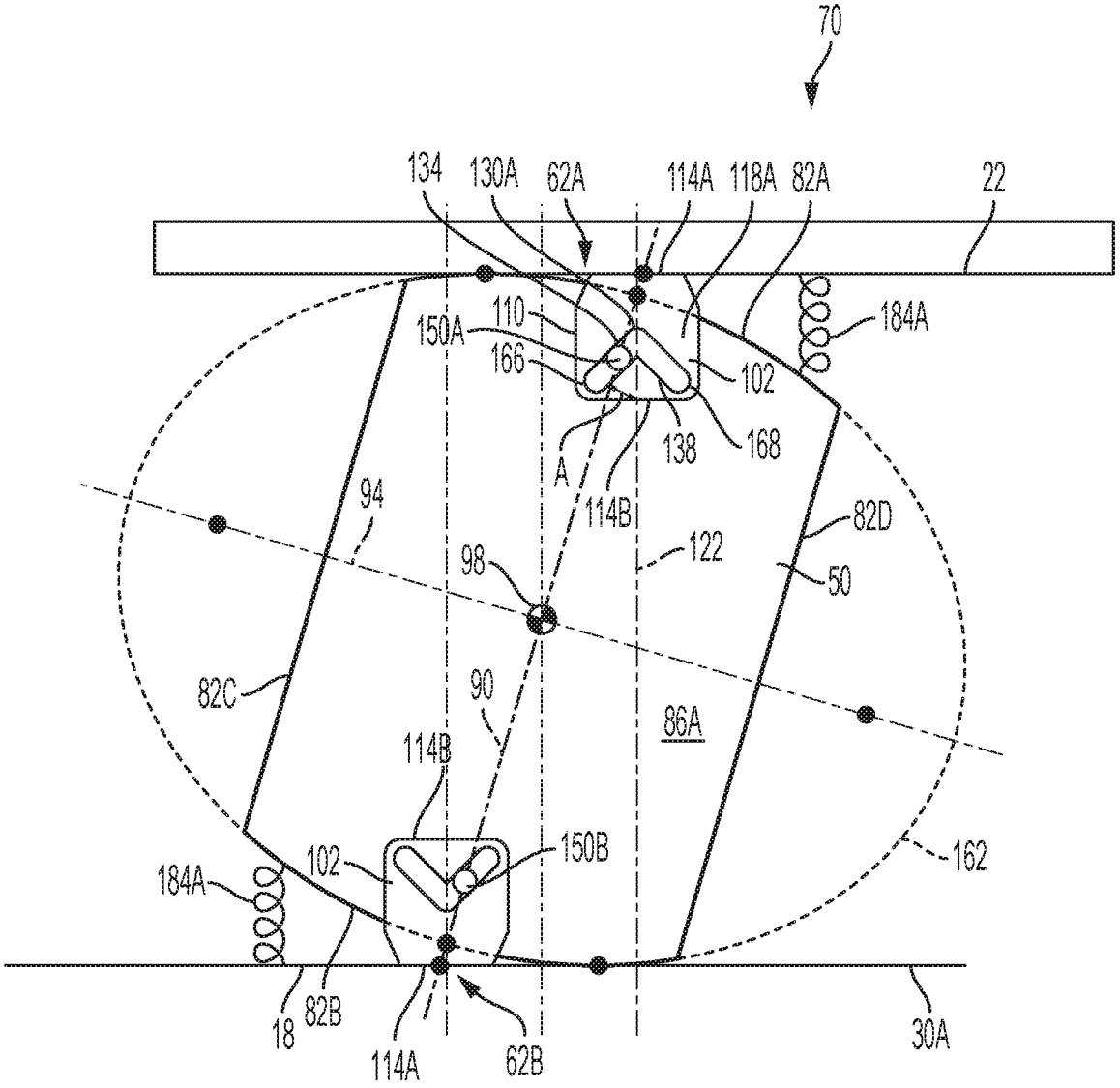
FIG. 3B is an elevation view of the panel assembly of FIG. 3A, illustrating the rocking panel in a rocking configuration.

In some embodiments, each wall connector assembly 62 includes a limiting member 184A-C. In one example, as shown in FIGS. 3A-3B, the wall connector assembly 62 includes a damping member 184A, such as a spring, positioned at each corner of the first edge 82A and the second edge 82B, and between the panel 50 and the respective beam 30. In another example, as shown in FIGS. 14-17, the wall connector assembly 62 includes a disc spring 184B. The disc spring 184B includes an aperture 188 (FIG. 17) configured to receive one of the end portions 158 of the pin 150. The disc spring 184B is positioned between and in contact with the end cap 180 and the respective face plate 102, 106. The spring 184A or the disc spring 184B is preloaded to a predetermined spring limit such that the force of the spring 184A,184B inhibits movement of the panel 50 and/or the pin 150 within the respective slot 130A, 130B until the forces (e.g., seismically induced forces) applied to the building are greater than the predetermined spring limit. For example, forces applied to the building 10, such as by wind, are configured to be less than the predetermined spring limit. As such, the rocking panel 50 is configured to not move or rock from forces due to wind on the building 10.

In another example of the limiting member 184A-C, as shown in FIGS. 8 and 9, the wall connector assembly 62 includes a plate 184C positioned on each end portion 158 of the pin 150. Similar to the disc spring 184B, the plate 184C includes an aperture 192 configured to receive one of the end portions 158 of the pin 150, and is positioned between and in contact with the end cap 180 and respective face plate 102, 106. The plate 184C includes "breakaway" fasteners in which each breakaway fastener includes a particular diameter or a notch that causes the fastener to fail when the seismically induced forces are greater than a predetermined force limit. The amount of material of the fastener from an edge of the fastener to the notch determines the predetermined force limit. The plate 184C having the breakaway fasteners is configured such that each of the breakaway fasteners do not fail when the force applied to the building 10, such as by wind, is not greater than the predetermined force limit. Alternatively, the plate 184C does not include the breakaway fasteners, but is adapted such that the pin 150 is configured to shear through the aperture 192 when the seismically induced forces are greater than the predetermined force limit. After a seismic event causing the breakaway fasteners to fail (or the plate 184C shears), the failed plate 184C may be replaced with a new plate 184C.

The limiting member 184A-184C is configured to maintain the panel 50 in a first position corresponding to a resting configuration of the panel 50. In particular, when the panel 50 is in the resting configuration, the first axis 90 of the panel 50 is aligned with the center axis 122 of the face plate 102, 106. As such, the third edge 82C and the fourth edge 82D of the panels 50 are configured to be substantially perpendicular to the floor structure 18 and the ceiling structure 22. When the forces applied to the building 20, such as seismically induced forces from an earthquake, are greater than the predetermined limit, the panel 50 is able to move into the second position corresponding to the rocking configuration of the panel 50. When the panel 50 is in the rocking configuration, the first axis 90 of the panel 50 pivots about the center axis 122 of the respective face plates 102, 106 such that the first axis 90 is misaligned with the center axis 122.

Figure 18:
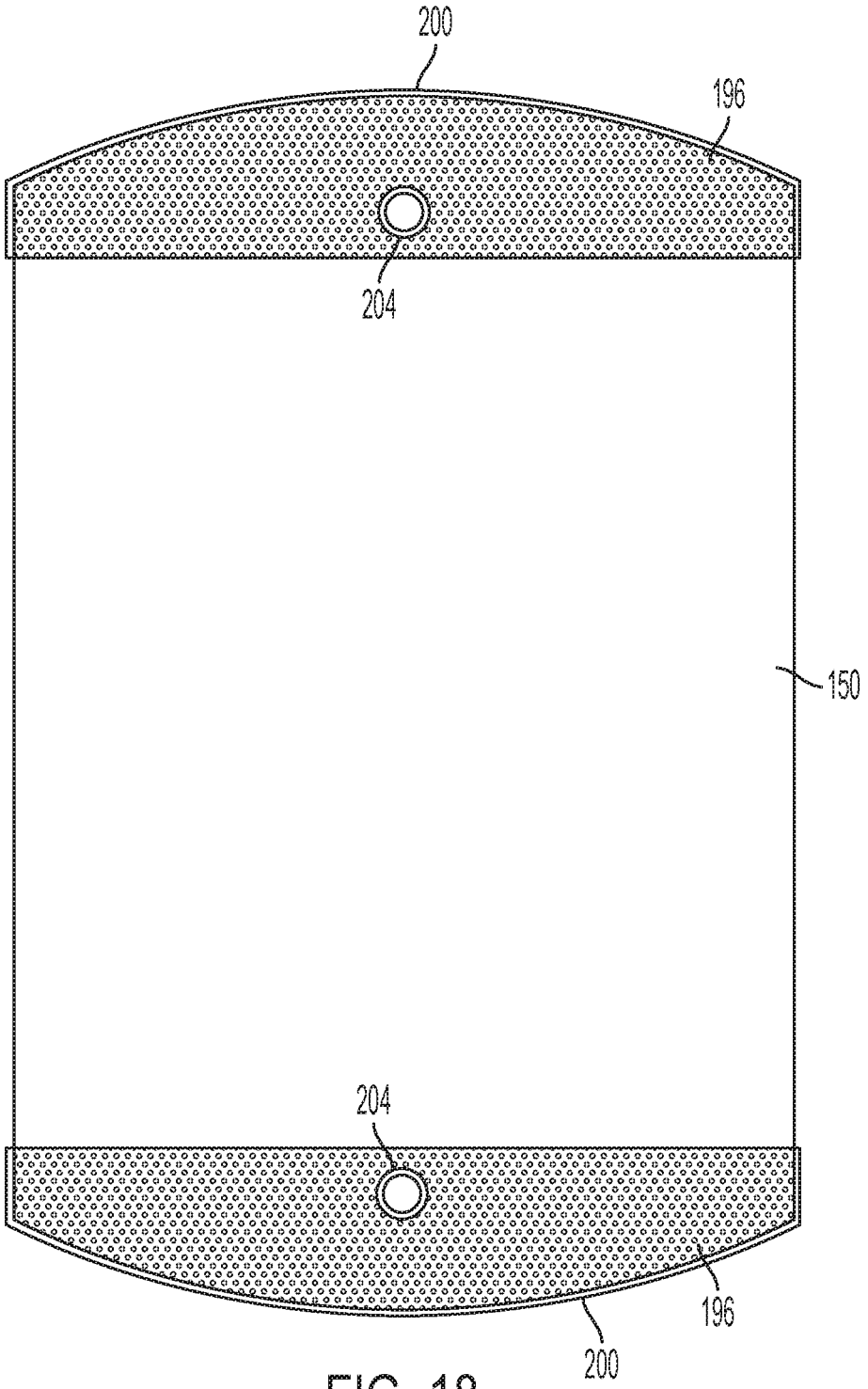
FIG. 18 is an elevation view of the rocking panel of FIG. 3A, illustrating an end cover positioned on each of a first edge and a second edge of the rocking panel.

With reference to FIG. 18, the panel 50 of the panel assembly 70 may further include an end cover 196 positioned on the first edge 82A and the second edge 82B of the panel 50. The end cover 196 includes an end surface 200 having a shape corresponding to the curvilinear shape of the first and second edges 82A, 82B. In addition, the end cover 196 includes a hole 204 to receive the end portion 158 of the pin 150. The end cover 196 may be configured as a wear plate for inhibiting damage to the first edge 82A and the second edge 82B of the panel 50, as the panel 50 moves relative to the floor structure 18 and the ceiling structure 22. In particular, with regard to the configuration of the wall connector assembly 62 having the vertical slot 130B, the end cover 196 is configured to reduce wear to the first and second edges 82A, 82B due to the slip friction between the panel 50 and the respective beam 30 (i.e., the floor structure 18 and the ceiling structure 22). Furthermore, lubrication may be applied to the end surface 200 to facilitate the sliding of the panel 50 relative to the floor structure 18 and the ceiling structure 22.

Accordingly, various embodiments of a panel assembly 70 including a panel 50 and a wall connector assembly 62 are described herein that enable the rocking movement of the panel 50 relative to the rigid structure (i.e., floor structure 18, ceiling structure 22) of a building 10. Although the disclosure has been described in detail with reference to certain embodiments, variations and modifications exist within the scope and spirit of one or more independent aspects of the disclosure as described. Various features and advantages of the disclosure are set forth in the following claims.

What is claimed is:

1. A panel assembly for a building, the building having a plurality of surfaces, the panel assembly comprising:

a panel configured to extend between a first surface and a second surface of the plurality of surfaces of the building, the panel movable along a predetermined path relative to the first surface and the second surface, the panel having a body extending between a first edge of the panel and a second edge opposite the first edge, the first edge engageable with one of the plurality of surfaces of the building, the second edge engageable with another of the plurality of surfaces of the building, the first edge and the second edge each having a curvilinear shape;

a first pin and a second pin coupled to the panel;

a first bottom face plate positioned on a first side of the panel and a second bottom face plate positioned on a second side of the panel opposite the first side, the first bottom face plate and the second bottom face plate configured to be rigidly coupled to the first surface, the first bottom face plate defining a first slot, and the second bottom face plate defining a second slot; and a first top face plate positioned on the first side of the panel and a second top face plate positioned on the second side of the panel, the first top face plate and the second top face plate configured to be rigidly coupled to the second surface, the first top face plate defining a third slot, and the second top face plate defining a fourth slot, wherein the first pin is received in the first slot and the second slot, and the second pin is received in the third slot and the fourth slot, wherein the first pin is movable in the first slot and the second slot, and the second pin is movable in the third slot and the fourth slot for guiding the movement of the panel along the predetermined path, wherein each of the first slot, the second slot, the third slot, and the fourth slot has an elongated shape extending between a first end and a second end for guiding movement of the first pin within the first slot and the second slot, and the second pin within the third slot and the fourth slot, as the panel moves along the predetermined path, wherein the curvilinear shape of the first edge and the second edge defines the predetermined path, and wherein the panel is configured to roll relative to the one of the plurality of surfaces and the another of the plurality of surfaces.

2. The panel assembly of claim 1, wherein the first slot, the second slot, the third slot, and the fourth slot each have the elongated shape corresponding to the curvilinear shape of the first edge and the second edge, and wherein the shape limits the movement of the panel along the predetermined path.

3. The panel assembly of claim 1, wherein each of the first face plate, the second face plate, the third face plate, and the fourth face plate includes a center axis extending perpendicular to a first edge and a second edge of the respective face plate and through a center of the respective face plate, and wherein at least a portion of the elongated shape of each slot is positioned on the respective center axis.

4. The panel assembly of claim 3, wherein the elongated shape has a first leg portion and a second leg portion, and wherein the first leg portion and the second leg portion each extend in in a direction at an angle relative to the center axis.

5. The panel assembly of claim 4, wherein the elongated shape of the first slot, the second slot, the third slot, and the fourth slot is a V shape.

6. The panel assembly of claim 3, wherein the elongated shape extends linearly along the center axis from the first end to the second end.

7. The panel assembly of claim 1, wherein the panel is formed of cross-laminated timber.

8. The panel assembly of claim 1, further comprising a limiting member for maintaining the panel in a first position corresponding to a resting configuration of the panel.

9. The panel assembly of claim 8, wherein the limiting member is selected from the group consisting of a damping member, a plate having breakaway fasteners, and a disc spring.

10. The panel assembly of claim 1, wherein the first surface is a floor structure, and the second surface is a ceiling structure.

11. The panel assembly of claim 1, wherein the panel is configured to slide relative to at least one of the one of the plurality of surfaces and the another of the plurality of surfaces.

12. A wall connector assembly for selective movement of a panel forming a section of a wall of a building, the building having a plurality of surfaces, the panel configured to extend between a first surface and a second surface of the plurality of surfaces of the building, the panel having a body extending between a first edge of the panel and a second edge opposite the first edge, the first edge configured to engage with one of the plurality of surfaces of the building, the second edge configured to engage with another of the plurality of surfaces of the building, the first edge and the second edge each having a curvilinear shape, wherein the curvilinear shape of the first edge and the second edge defines a predetermined path along which the panel moves, and wherein the panel is configured to roll relative to the one of the plurality of surfaces and the another of the plurality of surfaces, the wall connector assembly comprising:

a first face plate configured to be positioned on one side of the panel, the first face plate defining a first slot;

a second face plate configured to be positioned on another opposite side of the panel, the second face plate defining a second slot; and a pin configured to be coupled to the panel, and received in the first slot and the second slot for relative movement therewith, wherein the first face plate and the second face plate are configured to be rigidly coupled to one of the first surface and the second surface, wherein the pin is movable in the first slot and the second slot for guiding movement of the panel along the predetermined path relative to the one of the first surface and the second surface, and wherein each of the first slot and the second slot has an elongated shape extending between a first end and a second end for guiding movement of the pin within the first slot and the second slot as the panel moves along the predetermined path.

13. The wall connector assembly of claim 12, wherein each of the first face plate and the second face plate includes a center axis extending perpendicular to a first edge and a second edge of the respective face plate and through a center of the respective face plate, wherein the first slot and the second slot each have the elongated shape, and wherein at least a portion of the elongated shape of each slot is positioned on the center axis.

14. The wall connector assembly of claim 13, wherein the elongated shape has a first leg portion and a second leg portion, and wherein the first leg portion and the second leg portion each extend in in a direction at an angle relative to the center axis.

15. The wall connector assembly of claim 14, wherein the elongated shape of the first slot and the second slot is a V shape.

16. The wall connector assembly of claim 13, wherein the elongated shape extends linearly along the center axis from a first end of the slot to a second end of the slot opposite the first end.

17. The wall connector assembly of claim 12, further comprising a limiting member configured to maintain the panel in a first position corresponding to a resting configuration of the panel.

18. The wall connector assembly of claim 17, wherein the limiting member is selected from the group consisting of a damping member, a plate having breakaway fasteners, and a disc spring.

19. The panel assembly of claim 1, wherein the one of the plurality of surfaces is the first surface, and the another of the plurality of surfaces is the second surface.

20. The wall connector assembly of claim 12, wherein the one of the plurality of surfaces is the first surface, and the another of the plurality of surfaces is the second surface.

* * * * *